US011147346B2

(12) United States Patent
Takani

(10) Patent No.: US 11,147,346 B2
(45) Date of Patent: Oct. 19, 2021

(54) TAPE FOR SLIDE FASTENER

(71) Applicant: YKK Corporation, Tokyo (JP)

(72) Inventor: Go Takani, Guangdong (CN)

(73) Assignee: YKK Corporation, Tokyo (JP)

( * ) Notice: Subject to any disclaimer, the term of this patent is extended or adjusted under 35 U.S.C. 154(b) by 125 days.

(21) Appl. No.: 16/203,525

(22) Filed: Nov. 28, 2018

(65) Prior Publication Data

US 2019/0166959 A1 Jun. 6, 2019

(30) Foreign Application Priority Data

Dec. 1, 2017 (CN) ..... 201711249063.0
Dec. 1, 2017 (CN) ..... 201721651179.2

(51) Int. Cl.
*A44B 19/34* (2006.01)
*A44B 19/12* (2006.01)

(52) U.S. Cl.
CPC ..... *A44B 19/34* (2013.01); *A44B 19/12* (2013.01); *A44B 19/346* (2013.01)

(58) Field of Classification Search
CPC ..... A44B 19/34; A44B 19/12; A44B 19/346; A44B 19/343; Y10T 24/252
See application file for complete search history.

(56) References Cited

U.S. PATENT DOCUMENTS 4,149,569 A * 4/1979 Frohlich ..... A44B 19/12 139/11
5,699,592 A * 12/1997 Shimono ..... A44B 19/12 24/432
7,152,438 B2 * 12/2006 Matsuda ..... A44B 19/343 66/192
9,169,583 B2 * 10/2015 Hasegawa ..... A44B 19/346
9,668,549 B2 * 6/2017 Tsuzuyama ..... D03D 1/00
2005/0235466 A1 * 10/2005 Segawa ..... A44B 19/34 24/396
2011/0033687 A1 2/2011 Deguchi
(Continued)

FOREIGN PATENT DOCUMENTS

CN 103124505 A 5/2013
GB 1450162 A 9/1976
(Continued)

OTHER PUBLICATIONS

Office Action, Japanese Patent Application No. 2018-208264, dated Oct. 23, 2019.

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A tape for a slide fastener includes warps and wefts. A yarn count of warps among yarns forming the fastener tape is set to 22-28 dTex. A weave density of the warps is set to 205-231 yarns/inch. A yarn count of wefts among the yarns forming the fastener tape is set to 81-87 dTex. A weave density of the wefts is set to 42-48 yarns/inch. The weft is a multifilament formed by bundling 33-39 monofilaments. According to one embodiment, the yarn count of the warps is set to 25 dTex, the weave density of the warps is set to 210-226 yarns/inch, the yarn count of the weft is set to 84 dTex, the weave density of the wefts is set to 43-46 yarns/inch, and the weft is a multifilament formed by bundling 36 monofilaments.

1 Claim, 83 Drawing Sheets

(56) References Cited

U.S. PATENT DOCUMENTS

| | | | | |
|---|---|---|---|---|
| 2013/0177734 | A1 | 7/2013 | Hasegawa et al. | |
| 2019/0166959 | A1* | 6/2019 | Takani ..... | A44B 19/34 |

FOREIGN PATENT DOCUMENTS

| | | | |
|---|---|---|---|
| JP | S54-145306 | A | 3/1953 |
| JP | S49-043745 | A | 4/1974 |
| JP | 2006-175129 | A | 7/2006 |
| JP | 2013-177731 | A | 9/2013 |
| JP | 2014-214388 | A | 11/2014 |
| WO | 2014/013616 | A1 | 1/2014 |

* cited by examiner

FIG. 5

| Tape in black | | | Tape in white | |
|---|---|---|---|---|
| Wavelength (μm) | Light transmittance T (%) | | Wavelength (μm) | Light transmittance T (%) |
| 2500 | 20.8225 | | 2500 | 23.7313 |
| 2499 | 20.6391 | | 2499 | 23.9299 |
| 2498 | 21.4634 | | 2498 | 24.1843 |
| 2497 | 19.9055 | | 2497 | 23.1784 |
| 2496 | 20.9035 | | 2496 | 22.7633 |
| 2495 | 20.7094 | | 2495 | 23.4852 |
| 2494 | 20.7466 | | 2494 | 24.4853 |
| 2493 | 21.6674 | | 2493 | 24.5625 |
| 2492 | 19.7379 | | 2492 | 24.057 |
| 2491 | 19.9436 | | 2491 | 23.0936 |
| 2490 | 19.834 | | 2490 | 22.3935 |
| 2489 | 19.5324 | | 2489 | 22.4975 |
| 2488 | 20.264 | | 2488 | 22.4186 |
| 2487 | 19.8651 | | 2487 | 21.9792 |
| 2486 | 19.8963 | | 2486 | 21.8949 |
| 2485 | 20.4442 | | 2485 | 22.1385 |
| 2484 | 21.7887 | | 2484 | 23.1309 |
| 2483 | 22.4228 | | 2483 | 23.553 |
| 2482 | 21.6515 | | 2482 | 23.2246 |
| 2481 | 21.1329 | | 2481 | 22.9994 |
| 2480 | 20.2581 | | 2480 | 22.2106 |
| 2479 | 20.2413 | | 2479 | 22.1436 |
| 2478 | 19.5081 | | 2478 | 21.5618 |
| 2477 | 19.6998 | | 2477 | 21.7823 |
| 2476 | 19.3997 | | 2476 | 22.4206 |
| 2475 | 19.7047 | | 2475 | 23.3312 |
| 2474 | 21.8455 | | 2474 | 24.9918 |
| 2473 | 21.3373 | | 2473 | 24.5923 |

FIG. 6

| Tape in black | | | Tape in white | |
|---|---|---|---|---|
| Wavelength (μm) | Light transmittance T (%) | | Wavelength (μm) | Light transmittance T (%) |
| 2472 | 22.1188 | | 2472 | 24.9023 |
| 2471 | 22.4501 | | 2471 | 25.8877 |
| 2470 | 20.8589 | | 2470 | 24.3681 |
| 2469 | 22.2017 | | 2469 | 25.3144 |
| 2468 | 22.4576 | | 2468 | 25.0365 |
| 2467 | 21.1625 | | 2467 | 22.7728 |
| 2466 | 20.931 | | 2466 | 22.7941 |
| 2465 | 19.8976 | | 2465 | 22.0328 |
| 2464 | 18.6494 | | 2464 | 21.1559 |
| 2463 | 18.8941 | | 2463 | 21.8044 |
| 2462 | 20.0029 | | 2462 | 21.9526 |
| 2461 | 20.7885 | | 2461 | 22.2146 |
| 2460 | 21.4467 | | 2460 | 23.1074 |
| 2459 | 22.6943 | | 2459 | 22.7293 |
| 2458 | 22.9098 | | 2458 | 23.0387 |
| 2457 | 22.0748 | | 2457 | 22.2233 |
| 2456 | 21.7534 | | 2456 | 22.1873 |
| 2455 | 20.7829 | | 2455 | 22.6151 |
| 2454 | 19.6583 | | 2454 | 22.5766 |
| 2453 | 19.9917 | | 2453 | 23.5267 |
| 2452 | 19.9811 | | 2452 | 23.439 |
| 2451 | 19.5569 | | 2451 | 23.1999 |
| 2450 | 20.3724 | | 2450 | 23.8071 |
| 2449 | 20.0208 | | 2449 | 24.0868 |
| 2448 | 19.28 | | 2448 | 22.822 |
| 2447 | 19.9225 | | 2447 | 23.0199 |
| 2446 | 20.83 | | 2446 | 22.8693 |
| 2445 | 21.7515 | | 2445 | 23.3889 |

FIG. 7

| Tape in black | | | Tape in white | |
|---|---|---|---|---|
| Wavelength (μm) | Light transmittance T (%) | | Wavelength (μm) | Light transmittance T (%) |
| 2444 | 23.1061 | | 2444 | 25.2337 |
| 2443 | 22.9385 | | 2443 | 25.7043 |
| 2442 | 21.8865 | | 2442 | 25.05 |
| 2441 | 21.9247 | | 2441 | 24.2426 |
| 2440 | 22.232 | | 2440 | 24.274 |
| 2439 | 21.711 | | 2439 | 23.9744 |
| 2438 | 20.9793 | | 2438 | 24.2496 |
| 2437 | 20.6009 | | 2437 | 23.7282 |
| 2436 | 19.7202 | | 2436 | 23.4627 |
| 2435 | 20.294 | | 2435 | 23.6767 |
| 2434 | 20.4654 | | 2434 | 23.0543 |
| 2433 | 19.9449 | | 2433 | 23.6159 |
| 2432 | 20.9733 | | 2432 | 23.5008 |
| 2431 | 20.3513 | | 2431 | 23.8083 |
| 2430 | 21.2849 | | 2430 | 24.6358 |
| 2429 | 22.0859 | | 2429 | 24.9119 |
| 2428 | 21.4754 | | 2428 | 24.74 |
| 2427 | 21.3207 | | 2427 | 23.4769 |
| 2426 | 20.6348 | | 2426 | 23.3148 |
| 2425 | 19.9564 | | 2425 | 22.7634 |
| 2424 | 19.8995 | | 2424 | 23.1056 |
| 2423 | 19.848 | | 2423 | 23.8198 |
| 2422 | 20.0402 | | 2422 | 23.9697 |
| 2421 | 19.8612 | | 2421 | 23.6663 |
| 2420 | 20.055 | | 2420 | 23.7263 |
| 2419 | 20.5827 | | 2419 | 23.5758 |
| 2418 | 20.5665 | | 2418 | 24.5248 |
| 2417 | 20.7555 | | 2417 | 24.6641 |

FIG. 8

| Tape in black | | | Tape in white | |
|---|---|---|---|---|
| Wavelength (μm) | Light transmittance T (%) | | Wavelength (μm) | Light transmittance T (%) |
| 2416 | 20.2189 | | 2416 | 23.2915 |
| 2415 | 20.2727 | | 2415 | 23.9537 |
| 2414 | 20.0417 | | 2414 | 22.7539 |
| 2413 | 20.1488 | | 2413 | 22.0552 |
| 2412 | 20.5083 | | 2412 | 23.2017 |
| 2411 | 19.8625 | | 2411 | 22.3862 |
| 2410 | 20.9973 | | 2410 | 22.9291 |
| 2409 | 20.6671 | | 2409 | 23.8525 |
| 2408 | 20.3759 | | 2408 | 23.2581 |
| 2407 | 20.8696 | | 2407 | 23.8264 |
| 2406 | 19.4243 | | 2406 | 23.4334 |
| 2405 | 20.1488 | | 2405 | 23.6688 |
| 2404 | 20.1377 | | 2404 | 23.596 |
| 2403 | 20.0627 | | 2403 | 22.9663 |
| 2402 | 20.4416 | | 2402 | 22.7601 |
| 2401 | 19.5082 | | 2401 | 22.6324 |
| 2400 | 20.0927 | | 2400 | 23.0122 |
| 2399 | 19.9345 | | 2399 | 23.2941 |
| 2398 | 20.3013 | | 2398 | 23.4888 |
| 2397 | 20.7075 | | 2397 | 23.342 |
| 2396 | 19.9206 | | 2396 | 23.1581 |
| 2395 | 20.2521 | | 2395 | 23.164 |
| 2394 | 19.9561 | | 2394 | 23.2585 |
| 2393 | 20.037 | | 2393 | 23.4739 |
| 2392 | 20.6726 | | 2392 | 23.7404 |
| 2391 | 20.5748 | | 2391 | 23.6499 |
| 2390 | 20.2693 | | 2390 | 23.4812 |
| 2389 | 20.1671 | | 2389 | 23.4296 |

FIG. 9

| Tape in black | | | Tape in white | |
|---|---|---|---|---|
| Wavelength (μm) | Light transmittance T (%) | | Wavelength (μm) | Light transmittance T (%) |
| 2388 | 19.4638 | | 2388 | 23.4276 |
| 2387 | 19.3935 | | 2387 | 23.3674 |
| 2386 | 19.018 | | 2386 | 23.0111 |
| 2385 | 18.5461 | | 2385 | 22.8014 |
| 2384 | 19.0091 | | 2384 | 23.2655 |
| 2383 | 18.8866 | | 2383 | 22.924 |
| 2382 | 19.8576 | | 2382 | 23.6499 |
| 2381 | 20.0959 | | 2381 | 23.7151 |
| 2380 | 19.8294 | | 2380 | 23.077 |
| 2379 | 20.1184 | | 2379 | 23.8623 |
| 2378 | 19.7567 | | 2378 | 23.2292 |
| 2377 | 19.9137 | | 2377 | 22.8513 |
| 2376 | 19.6745 | | 2376 | 22.6335 |
| 2375 | 20.009 | | 2375 | 22.93 |
| 2374 | 20.249 | | 2374 | 23.4342 |
| 2373 | 20.4103 | | 2373 | 23.9757 |
| 2372 | 20.6855 | | 2372 | 23.877 |
| 2371 | 20.369 | | 2371 | 23.674 |
| 2370 | 20.0776 | | 2370 | 23.4624 |
| 2369 | 19.8563 | | 2369 | 23.6531 |
| 2368 | 20.0706 | | 2368 | 24.2747 |
| 2367 | 19.7915 | | 2367 | 23.8358 |
| 2366 | 20.1228 | | 2366 | 23.918 |
| 2365 | 20.0702 | | 2365 | 23.6427 |
| 2364 | 20.3577 | | 2364 | 23.8159 |
| 2363 | 20.7976 | | 2363 | 24.1554 |
| 2362 | 20.9194 | | 2362 | 24.471 |
| 2361 | 21.5828 | | 2361 | 24.957 |

FIG. 10

| Tape in black | | | Tape in white | |
|---|---|---|---|---|
| Wavelength (μm) | Light transmittance T (%) | | Wavelength (μm) | Light transmittance T (%) |
| 2360 | 21.2507 | | 2360 | 24.4765 |
| 2359 | 21.3001 | | 2359 | 24.6303 |
| 2358 | 21.4587 | | 2358 | 24.5456 |
| 2357 | 21.279 | | 2357 | 24.1122 |
| 2356 | 21.6741 | | 2356 | 25.0556 |
| 2355 | 21.8272 | | 2355 | 25.0168 |
| 2354 | 21.6811 | | 2354 | 24.9495 |
| 2353 | 21.5385 | | 2353 | 25.0189 |
| 2352 | 20.8254 | | 2352 | 24.0242 |
| 2351 | 20.38 | | 2351 | 23.5873 |
| 2350 | 20.3939 | | 2350 | 23.8969 |
| 2349 | 20.2285 | | 2349 | 23.1449 |
| 2348 | 20.5626 | | 2348 | 23.3431 |
| 2347 | 20.525 | | 2347 | 23.4015 |
| 2346 | 20.7342 | | 2346 | 22.6203 |
| 2345 | 20.788 | | 2345 | 23.513 |
| 2344 | 20.6299 | | 2344 | 23.913 |
| 2343 | 20.6026 | | 2343 | 23.7595 |
| 2342 | 19.9838 | | 2342 | 24.2817 |
| 2341 | 19.9139 | | 2341 | 23.8955 |
| 2340 | 19.7174 | | 2340 | 23.1407 |
| 2339 | 19.6807 | | 2339 | 23.0483 |
| 2338 | 19.9298 | | 2338 | 23.0766 |
| 2337 | 20.2157 | | 2337 | 23.3399 |
| 2336 | 20.7377 | | 2336 | 23.5318 |
| 2335 | 20.9068 | | 2335 | 23.6626 |
| 2334 | 21.0284 | | 2334 | 23.2691 |
| 2333 | 21.4109 | | 2333 | 23.5356 |

FIG. 11

| Tape in black | | | Tape in white | |
|---|---|---|---|---|
| Wavelength (μm) | Light transmittance T (%) | | Wavelength (μm) | Light transmittance T (%) |
| 2332 | 20.9074 | | 2332 | 23.6446 |
| 2331 | 20.7828 | | 2331 | 24.2648 |
| 2330 | 20.5085 | | 2330 | 24.4612 |
| 2329 | 20.3125 | | 2329 | 24.2236 |
| 2328 | 20.9489 | | 2328 | 24.4012 |
| 2327 | 21.3958 | | 2327 | 23.7635 |
| 2326 | 21.6204 | | 2326 | 24.0707 |
| 2325 | 21.7234 | | 2325 | 24.7447 |
| 2324 | 21.2935 | | 2324 | 24.539 |
| 2323 | 20.7245 | | 2323 | 24.8638 |
| 2322 | 20.7936 | | 2322 | 24.6358 |
| 2321 | 20.7834 | | 2321 | 23.5807 |
| 2320 | 20.2738 | | 2320 | 23.2298 |
| 2319 | 20.3766 | | 2319 | 22.8946 |
| 2318 | 20.6584 | | 2318 | 23.2496 |
| 2317 | 20.4276 | | 2317 | 23.151 |
| 2316 | 21.3033 | | 2316 | 23.7172 |
| 2315 | 21.5201 | | 2315 | 24.1345 |
| 2314 | 20.8412 | | 2314 | 23.5321 |
| 2313 | 20.9711 | | 2313 | 24.3244 |
| 2312 | 20.9053 | | 2312 | 24.4165 |
| 2311 | 20.6776 | | 2311 | 23.9165 |
| 2310 | 21.3309 | | 2310 | 24.4806 |
| 2309 | 20.6673 | | 2309 | 23.8407 |
| 2308 | 20.3517 | | 2308 | 23.7826 |
| 2307 | 20.0835 | | 2307 | 23.8282 |
| 2306 | 19.4491 | | 2306 | 23.314 |
| 2305 | 19.4498 | | 2305 | 23.4473 |

FIG. 12

| Tape in black | | | Tape in white | |
|---|---|---|---|---|
| Wavelength (μm) | Light transmittance T (%) | | Wavelength (μm) | Light transmittance T (%) |
| 2304 | 19.5903 | | 2304 | 23.2497 |
| 2303 | 19.923 | | 2303 | 23.5033 |
| 2302 | 19.7974 | | 2302 | 23.4403 |
| 2301 | 20.7885 | | 2301 | 24.1406 |
| 2300 | 20.8977 | | 2300 | 24.3559 |
| 2299 | 20.8847 | | 2299 | 24.2178 |
| 2298 | 21.3899 | | 2298 | 24.6966 |
| 2297 | 20.532 | | 2297 | 23.8195 |
| 2296 | 20.9205 | | 2296 | 23.8428 |
| 2295 | 21.0043 | | 2295 | 23.9705 |
| 2294 | 20.7663 | | 2294 | 23.9715 |
| 2293 | 21.0782 | | 2293 | 24.5141 |
| 2292 | 20.7582 | | 2292 | 24.3739 |
| 2291 | 21.0841 | | 2291 | 24.86 |
| 2290 | 21.1648 | | 2290 | 25.1285 |
| 2289 | 21.0908 | | 2289 | 24.9677 |
| 2288 | 20.8567 | | 2288 | 24.9807 |
| 2287 | 20.4787 | | 2287 | 24.5243 |
| 2286 | 20.3368 | | 2286 | 23.8681 |
| 2285 | 20.3453 | | 2285 | 23.6826 |
| 2284 | 20.6529 | | 2284 | 24.1509 |
| 2283 | 20.2376 | | 2283 | 23.9425 |
| 2282 | 20.6472 | | 2282 | 24.3186 |
| 2281 | 20.7362 | | 2281 | 24.6234 |
| 2280 | 20.3586 | | 2280 | 24.1705 |
| 2279 | 20.9378 | | 2279 | 24.5121 |
| 2278 | 20.7104 | | 2278 | 24.5852 |
| 2277 | 20.4731 | | 2277 | 24.3943 |

FIG. 13

| Tape in black | | | Tape in white | |
|---|---|---|---|---|
| Wavelength (μm) | Light transmittance T (%) | | Wavelength (μm) | Light transmittance T (%) |
| 2276 | 21.0378 | | 2276 | 24.5359 |
| 2275 | 21.0506 | | 2275 | 24.7063 |
| 2274 | 21.1796 | | 2274 | 24.4749 |
| 2273 | 21.2443 | | 2273 | 24.4558 |
| 2272 | 21.5269 | | 2272 | 24.7852 |
| 2271 | 21.3231 | | 2271 | 24.5263 |
| 2270 | 21.0024 | | 2270 | 24.2692 |
| 2269 | 21.065 | | 2269 | 24.2144 |
| 2268 | 20.619 | | 2268 | 23.7959 |
| 2267 | 20.9962 | | 2267 | 23.8979 |
| 2266 | 20.9343 | | 2266 | 24.1589 |
| 2265 | 21.0734 | | 2265 | 24.2938 |
| 2264 | 21.0484 | | 2264 | 24.5203 |
| 2263 | 21.1419 | | 2263 | 24.3866 |
| 2262 | 21.4877 | | 2262 | 24.3079 |
| 2261 | 21.27 | | 2261 | 24.0722 |
| 2260 | 21.2349 | | 2260 | 24.3002 |
| 2259 | 20.7669 | | 2259 | 24.428 |
| 2258 | 20.8053 | | 2258 | 24.7736 |
| 2257 | 21.0872 | | 2257 | 24.9529 |
| 2256 | 21.2075 | | 2256 | 24.6165 |
| 2255 | 21.3271 | | 2255 | 24.544 |
| 2254 | 21.274 | | 2254 | 24.3092 |
| 2253 | 20.938 | | 2253 | 24.1621 |
| 2252 | 20.5832 | | 2252 | 24.1008 |
| 2251 | 20.6211 | | 2251 | 24.3633 |
| 2250 | 20.2975 | | 2250 | 24.1308 |
| 2249 | 20.5318 | | 2249 | 24.477 |

FIG. 14

| Tape in black | | | Tape in white | |
|---|---|---|---|---|
| Wavelength (μm) | Light transmittance T (%) | | Wavelength (μm) | Light transmittance T (%) |
| 2248 | 21.0266 | | 2248 | 24.6103 |
| 2247 | 20.966 | | 2247 | 24.3094 |
| 2246 | 21.2804 | | 2246 | 24.8749 |
| 2245 | 21.0883 | | 2245 | 24.3059 |
| 2244 | 20.6847 | | 2244 | 24.3209 |
| 2243 | 20.578 | | 2243 | 24.2085 |
| 2242 | 20.2154 | | 2242 | 23.9079 |
| 2241 | 20.28 | | 2241 | 24.1615 |
| 2240 | 20.1226 | | 2240 | 23.9188 |
| 2239 | 20.0905 | | 2239 | 24.2986 |
| 2238 | 20.6671 | | 2238 | 24.1682 |
| 2237 | 20.5352 | | 2237 | 24.034 |
| 2236 | 20.9557 | | 2236 | 24.2114 |
| 2235 | 21.1962 | | 2235 | 24.324 |
| 2234 | 21.1383 | | 2234 | 24.461 |
| 2233 | 21.5334 | | 2233 | 24.9732 |
| 2232 | 21.3113 | | 2232 | 24.7124 |
| 2231 | 21.0479 | | 2231 | 24.1391 |
| 2230 | 20.7994 | | 2230 | 24.1372 |
| 2229 | 21.027 | | 2229 | 24.2002 |
| 2228 | 20.8491 | | 2228 | 24.1876 |
| 2227 | 20.9924 | | 2227 | 24.4604 |
| 2226 | 20.98 | | 2226 | 24.347 |
| 2225 | 20.6796 | | 2225 | 24.2126 |
| 2224 | 21.0663 | | 2224 | 24.3084 |
| 2223 | 21.2915 | | 2223 | 24.6032 |
| 2222 | 21.6494 | | 2222 | 24.9106 |

FIG. 15

| Tape in black | | | Tape in white | |
|---|---|---|---|---|
| Wavelength (μm) | Light transmittance T (%) | | Wavelength (μm) | Light transmittance T (%) |
| 2221 | 21.739 | | 2221 | 24.59 |
| 2220 | 21.7319 | | 2220 | 24.6605 |
| 2219 | 21.9349 | | 2219 | 24.365 |
| 2218 | 21.4854 | | 2218 | 24.1716 |
| 2217 | 21.401 | | 2217 | 24.3209 |
| 2216 | 21.3938 | | 2216 | 24.4352 |
| 2215 | 20.9786 | | 2215 | 24.4223 |
| 2214 | 21.0878 | | 2214 | 24.3851 |
| 2213 | 21.2351 | | 2213 | 24.4697 |
| 2212 | 21.0495 | | 2212 | 24.2946 |
| 2211 | 21.2019 | | 2211 | 24.5232 |
| 2210 | 21.1621 | | 2210 | 24.5405 |
| 2209 | 20.8989 | | 2209 | 24.1911 |
| 2208 | 21.0841 | | 2208 | 24.2035 |
| 2207 | 21.1156 | | 2207 | 24.0076 |
| 2206 | 21.2798 | | 2206 | 24.2996 |
| 2205 | 21.2973 | | 2205 | 24.7133 |
| 2204 | 21.134 | | 2204 | 24.8501 |
| 2203 | 21.0783 | | 2203 | 25.0088 |
| 2202 | 21.0813 | | 2202 | 24.8168 |
| 2201 | 21.3669 | | 2201 | 24.8349 |
| 2200 | 21.3683 | | 2200 | 24.7434 |
| 2199 | 21.1331 | | 2199 | 24.6222 |
| 2198 | 21.194 | | 2198 | 25.035 |
| 2197 | 20.6622 | | 2197 | 24.7686 |
| 2196 | 20.822 | | 2196 | 24.7402 |
| 2195 | 21.2599 | | 2195 | 24.8583 |
| 2194 | 20.9169 | | 2194 | 24.3991 |

FIG. 16

| Tape in black | | | Tape in white | |
|---|---|---|---|---|
| Wavelength (μm) | Light transmittance T (%) | | Wavelength (μm) | Light transmittance T (%) |
| 2193 | 21.1561 | | 2193 | 24.6642 |
| 2192 | 21.1678 | | 2192 | 24.852 |
| 2191 | 20.8938 | | 2191 | 24.5874 |
| 2190 | 20.9954 | | 2190 | 24.4113 |
| 2189 | 20.9154 | | 2189 | 24.2536 |
| 2188 | 21.0807 | | 2188 | 24.1037 |
| 2187 | 21.4344 | | 2187 | 24.5073 |
| 2186 | 21.4304 | | 2186 | 24.519 |
| 2185 | 21.3336 | | 2185 | 24.6033 |
| 2184 | 20.9671 | | 2184 | 24.6343 |
| 2183 | 20.7242 | | 2183 | 24.4656 |
| 2182 | 20.9186 | | 2182 | 24.752 |
| 2181 | 21.0932 | | 2181 | 24.61 |
| 2180 | 21.1881 | | 2180 | 24.528 |
| 2179 | 21.3579 | | 2179 | 24.689 |
| 2178 | 21.4244 | | 2178 | 24.5917 |
| 2177 | 21.6347 | | 2177 | 24.9473 |
| 2176 | 21.7124 | | 2176 | 25.0891 |
| 2175 | 21.3713 | | 2175 | 24.7088 |
| 2174 | 21.1551 | | 2174 | 24.7659 |
| 2173 | 20.9774 | | 2173 | 24.6676 |
| 2172 | 20.7269 | | 2172 | 24.4345 |
| 2171 | 21.1614 | | 2171 | 24.8455 |
| 2170 | 21.1854 | | 2170 | 24.7629 |
| 2169 | 21.443 | | 2169 | 24.8017 |
| 2168 | 21.4863 | | 2168 | 24.943 |
| 2167 | 21.3961 | | 2167 | 24.8015 |
| 2166 | 21.5504 | | 2166 | 25.1282 |

FIG. 17

| Tape in black | | | Tape in white | |
|---|---|---|---|---|
| Wavelength (μm) | Light transmittance T (%) | | Wavelength (μm) | Light transmittance T (%) |
| 2165 | 21.2845 | | 2165 | 24.7927 |
| 2164 | 21.322 | | 2164 | 24.7083 |
| 2163 | 21.0036 | | 2163 | 24.7362 |
| 2162 | 21.0132 | | 2162 | 24.2949 |
| 2161 | 20.9858 | | 2161 | 24.4622 |
| 2160 | 20.8878 | | 2160 | 24.4591 |
| 2159 | 21.0863 | | 2159 | 24.3782 |
| 2158 | 20.718 | | 2158 | 24.3008 |
| 2157 | 20.667 | | 2157 | 24.468 |
| 2156 | 21.0471 | | 2156 | 24.6297 |
| 2155 | 20.847 | | 2155 | 24.3951 |
| 2154 | 21.212 | | 2154 | 24.5981 |
| 2153 | 21.1375 | | 2153 | 24.444 |
| 2152 | 20.8854 | | 2152 | 24.4261 |
| 2151 | 20.9512 | | 2151 | 24.576 |
| 2150 | 20.5029 | | 2150 | 24.4445 |
| 2149 | 20.5556 | | 2149 | 24.3567 |
| 2148 | 20.7318 | | 2148 | 24.7211 |
| 2147 | 20.917 | | 2147 | 24.6226 |
| 2146 | 21.4453 | | 2146 | 25.1753 |
| 2145 | 21.5451 | | 2145 | 25.2516 |
| 2144 | 21.2841 | | 2144 | 24.8536 |
| 2143 | 21.165 | | 2143 | 24.8932 |
| 2142 | 20.9042 | | 2142 | 24.4635 |
| 2141 | 20.9827 | | 2141 | 24.39 |
| 2140 | 20.9551 | | 2140 | 24.304 |
| 2139 | 21.1972 | | 2139 | 24.4808 |
| 2138 | 21.2293 | | 2138 | 24.3779 |

FIG. 18

| Tape in black | | | Tape in white | |
|---|---|---|---|---|
| Wavelength (μm) | Light transmittance T (%) | | Wavelength (μm) | Light transmittance T (%) |
| 2137 | 21.1843 | | 2137 | 24.5521 |
| 2136 | 21.3941 | | 2136 | 24.6033 |
| 2135 | 21.1678 | | 2135 | 24.7492 |
| 2134 | 21.1175 | | 2134 | 24.7473 |
| 2133 | 21.1165 | | 2133 | 24.6172 |
| 2132 | 21.077 | | 2132 | 24.7495 |
| 2131 | 20.724 | | 2131 | 24.3356 |
| 2130 | 20.9017 | | 2130 | 24.4468 |
| 2129 | 20.7677 | | 2129 | 24.4312 |
| 2128 | 20.7191 | | 2128 | 24.5115 |
| 2127 | 20.7815 | | 2127 | 24.4472 |
| 2126 | 20.7893 | | 2126 | 24.5267 |
| 2125 | 20.7844 | | 2125 | 24.4792 |
| 2124 | 20.9753 | | 2124 | 24.4889 |
| 2123 | 21.1438 | | 2123 | 24.6159 |
| 2122 | 20.9852 | | 2122 | 24.5771 |
| 2121 | 21.1169 | | 2121 | 24.7 |
| 2120 | 20.9305 | | 2120 | 24.4388 |
| 2119 | 20.9478 | | 2119 | 24.5155 |
| 2118 | 21.0354 | | 2118 | 24.5821 |
| 2117 | 21.1345 | | 2117 | 24.8046 |
| 2116 | 21.2793 | | 2116 | 24.8856 |
| 2115 | 21.3739 | | 2115 | 24.8859 |
| 2114 | 21.4149 | | 2114 | 24.8068 |
| 2113 | 21.1322 | | 2113 | 24.4064 |
| 2112 | 20.9921 | | 2112 | 24.3037 |
| 2111 | 20.7892 | | 2111 | 24.3688 |
| 2110 | 20.7121 | | 2110 | 24.349 |

FIG. 19

| Tape in black | | | Tape in white | |
|---|---|---|---|---|
| Wavelength (μm) | Light transmittance T (%) | | Wavelength (μm) | Light transmittance T (%) |
| 2109 | 20.5771 | | 2109 | 24.3032 |
| 2108 | 20.502 | | 2108 | 24.4479 |
| 2107 | 20.7473 | | 2107 | 24.5782 |
| 2106 | 20.4867 | | 2106 | 24.1888 |
| 2105 | 20.7703 | | 2105 | 24.3183 |
| 2104 | 20.9829 | | 2104 | 24.2998 |
| 2103 | 21.0966 | | 2103 | 24.3098 |
| 2102 | 21.4666 | | 2102 | 24.5597 |
| 2101 | 21.6078 | | 2101 | 24.7905 |
| 2100 | 21.4975 | | 2100 | 24.9012 |
| 2099 | 21.4346 | | 2099 | 24.9261 |
| 2098 | 21.5033 | | 2098 | 25.0906 |
| 2097 | 21.4117 | | 2097 | 24.9968 |
| 2096 | 21.3047 | | 2096 | 24.7065 |
| 2095 | 20.9488 | | 2095 | 24.6249 |
| 2094 | 21.0654 | | 2094 | 24.6595 |
| 2093 | 21.1371 | | 2093 | 24.5306 |
| 2092 | 21.4131 | | 2092 | 24.9098 |
| 2091 | 21.7275 | | 2091 | 24.8311 |
| 2090 | 21.4534 | | 2090 | 24.7392 |
| 2089 | 21.4208 | | 2089 | 24.6816 |
| 2088 | 21.2651 | | 2088 | 24.4945 |
| 2087 | 21.4546 | | 2087 | 24.6233 |
| 2086 | 21.6158 | | 2086 | 24.8277 |
| 2085 | 21.5569 | | 2085 | 24.9769 |
| 2084 | 21.4215 | | 2084 | 24.7776 |
| 2083 | 21.2015 | | 2083 | 24.6209 |
| 2082 | 21.0095 | | 2082 | 24.3854 |

FIG. 20

| Tape in black | | | Tape in white | |
|---|---|---|---|---|
| Wavelength (μm) | Light transmittance T (%) | | Wavelength (μm) | Light transmittance T (%) |
| 2081 | 21.1537 | | 2081 | 24.5276 |
| 2080 | 20.9984 | | 2080 | 24.6163 |
| 2079 | 21.0256 | | 2079 | 24.6774 |
| 2078 | 21.2263 | | 2078 | 25.0046 |
| 2077 | 21.041 | | 2077 | 24.8714 |
| 2076 | 21.0851 | | 2076 | 24.9393 |
| 2075 | 20.8657 | | 2075 | 24.8529 |
| 2074 | 20.7712 | | 2074 | 24.6606 |
| 2073 | 20.9159 | | 2073 | 24.7585 |
| 2072 | 21.1648 | | 2072 | 24.6411 |
| 2071 | 21.4115 | | 2071 | 24.7535 |
| 2070 | 21.5081 | | 2070 | 24.9278 |
| 2069 | 21.4864 | | 2069 | 24.8313 |
| 2068 | 21.5564 | | 2068 | 25.0473 |
| 2067 | 21.5029 | | 2067 | 25.1645 |
| 2066 | 21.3761 | | 2066 | 24.9916 |
| 2065 | 21.3489 | | 2065 | 24.8773 |
| 2064 | 21.3133 | | 2064 | 24.7313 |
| 2063 | 21.2913 | | 2063 | 24.6309 |
| 2062 | 21.2603 | | 2062 | 24.4927 |
| 2061 | 21.3211 | | 2061 | 24.5134 |
| 2060 | 21.3001 | | 2060 | 24.5281 |
| 2059 | 21.5281 | | 2059 | 24.59 |
| 2058 | 21.483 | | 2058 | 24.8127 |
| 2057 | 21.1269 | | 2057 | 24.7532 |
| 2056 | 21.034 | | 2056 | 24.7682 |
| 2055 | 20.9212 | | 2055 | 24.8206 |
| 2054 | 20.9298 | | 2054 | 24.6181 |

FIG. 21

| Tape in black | | | Tape in white | |
|---|---|---|---|---|
| Wavelength (μm) | Light transmittance T (%) | | Wavelength (μm) | Light transmittance T (%) |
| 2053 | 21.1377 | | 2053 | 24.7847 |
| 2052 | 21.1069 | | 2052 | 24.6699 |
| 2051 | 21.0036 | | 2051 | 24.4762 |
| 2050 | 20.8672 | | 2050 | 24.6254 |
| 2049 | 20.8459 | | 2049 | 24.5248 |
| 2048 | 20.9273 | | 2048 | 24.7721 |
| 2047 | 21.087 | | 2047 | 24.8386 |
| 2046 | 21.221 | | 2046 | 24.9289 |
| 2045 | 21.305 | | 2045 | 25.0052 |
| 2044 | 21.0497 | | 2044 | 24.7347 |
| 2043 | 20.9455 | | 2043 | 24.8092 |
| 2042 | 20.9666 | | 2042 | 24.5881 |
| 2041 | 20.8722 | | 2041 | 24.5402 |
| 2040 | 21.157 | | 2040 | 24.7489 |
| 2039 | 20.982 | | 2039 | 24.6468 |
| 2038 | 20.9815 | | 2038 | 24.5375 |
| 2037 | 21.0093 | | 2037 | 24.545 |
| 2036 | 20.9845 | | 2036 | 24.507 |
| 2035 | 21.1242 | | 2035 | 24.4848 |
| 2034 | 21.1936 | | 2034 | 24.5219 |
| 2033 | 21.2468 | | 2033 | 24.6159 |
| 2032 | 21.3202 | | 2032 | 24.8488 |
| 2031 | 21.3119 | | 2031 | 25.0328 |
| 2030 | 21.3788 | | 2030 | 25.2742 |
| 2029 | 21.3492 | | 2029 | 25.0584 |
| 2028 | 21.1692 | | 2028 | 24.7934 |
| 2027 | 21.019 | | 2027 | 24.6261 |
| 2026 | 20.655 | | 2026 | 24.4226 |

FIG. 22

| Tape in black | | | Tape in white | |
|---|---|---|---|---|
| Wavelength (μm) | Light transmittance T (%) | | Wavelength (μm) | Light transmittance T (%) |
| 2025 | 20.6259 | | 2025 | 24.6568 |
| 2024 | 20.7063 | | 2024 | 24.7931 |
| 2023 | 20.7067 | | 2023 | 24.6528 |
| 2022 | 21.0512 | | 2022 | 24.7997 |
| 2021 | 20.9372 | | 2021 | 24.6129 |
| 2020 | 21.0328 | | 2020 | 24.3265 |
| 2019 | 21.069 | | 2019 | 24.3857 |
| 2018 | 21.0402 | | 2018 | 24.5133 |
| 2017 | 21.1792 | | 2017 | 24.761 |
| 2016 | 21.0113 | | 2016 | 24.9049 |
| 2015 | 21.2701 | | 2015 | 25.0833 |
| 2014 | 21.2432 | | 2014 | 24.907 |
| 2013 | 21.3702 | | 2013 | 24.8395 |
| 2012 | 21.6018 | | 2012 | 25.0435 |
| 2011 | 21.5318 | | 2011 | 24.8566 |
| 2010 | 21.3891 | | 2010 | 24.7506 |
| 2009 | 21.3088 | | 2009 | 24.7016 |
| 2008 | 21.2215 | | 2008 | 24.7223 |
| 2007 | 21.3684 | | 2007 | 24.8457 |
| 2006 | 21.6003 | | 2006 | 25.1532 |
| 2005 | 21.5502 | | 2005 | 25.1535 |
| 2004 | 21.7191 | | 2004 | 25.26 |
| 2003 | 21.6505 | | 2003 | 25.0906 |
| 2002 | 21.6741 | | 2002 | 25.0041 |
| 2001 | 21.5463 | | 2001 | 24.8988 |
| 2000 | 21.2829 | | 2000 | 24.716 |
| 1999 | 21.0841 | | 1999 | 24.774 |
| 1998 | 20.8336 | | 1998 | 24.6161 |

FIG. 23

| Tape in black | | | Tape in white | |
|---|---|---|---|---|
| Wavelength (μm) | Light transmittance T (%) | | Wavelength (μm) | Light transmittance T (%) |
| 1997 | 20.9435 | | 1997 | 24.525 |
| 1996 | 20.8853 | | 1996 | 24.467 |
| 1995 | 20.829 | | 1995 | 24.5197 |
| 1994 | 21.0328 | | 1994 | 24.5684 |
| 1993 | 20.9742 | | 1993 | 24.7013 |
| 1992 | 21.173 | | 1992 | 24.8217 |
| 1991 | 21.1715 | | 1991 | 24.817 |
| 1990 | 20.8458 | | 1990 | 24.6569 |
| 1989 | 20.924 | | 1989 | 24.8348 |
| 1988 | 21.0217 | | 1988 | 24.7504 |
| 1987 | 21.1075 | | 1987 | 24.8016 |
| 1986 | 21.4558 | | 1986 | 24.9988 |
| 1985 | 21.4501 | | 1985 | 24.8311 |
| 1984 | 21.2761 | | 1984 | 24.7278 |
| 1983 | 21.1289 | | 1983 | 24.7184 |
| 1982 | 21.0876 | | 1982 | 24.7098 |
| 1981 | 21.0266 | | 1981 | 24.7005 |
| 1980 | 20.9575 | | 1980 | 24.8245 |
| 1979 | 21.0181 | | 1979 | 24.7916 |
| 1978 | 20.7554 | | 1978 | 24.6445 |
| 1977 | 20.7771 | | 1977 | 24.6534 |
| 1976 | 20.6121 | | 1976 | 24.3281 |
| 1975 | 20.7154 | | 1975 | 24.3953 |
| 1974 | 20.8741 | | 1974 | 24.4011 |
| 1973 | 20.9722 | | 1973 | 24.3146 |
| 1972 | 21.1165 | | 1972 | 24.6819 |
| 1971 | 21.104 | | 1971 | 24.5342 |
| 1970 | 21.1632 | | 1970 | 24.6656 |

FIG. 24

| Tape in black | | | Tape in white | |
|---|---|---|---|---|
| Wavelength (μm) | Light transmittance T (%) | | Wavelength (μm) | Light transmittance T (%) |
| 1969 | 21.0993 | | 1969 | 24.8437 |
| 1968 | 21.0262 | | 1968 | 24.7747 |
| 1967 | 21.0831 | | 1967 | 24.7926 |
| 1966 | 20.9673 | | 1966 | 24.8541 |
| 1965 | 21.0636 | | 1965 | 24.8451 |
| 1964 | 21.0566 | | 1964 | 24.7635 |
| 1963 | 20.8102 | | 1963 | 24.7573 |
| 1962 | 20.9966 | | 1962 | 24.7321 |
| 1961 | 20.6477 | | 1961 | 24.3573 |
| 1960 | 20.9791 | | 1960 | 24.6421 |
| 1959 | 21.1892 | | 1959 | 24.7354 |
| 1958 | 21.208 | | 1958 | 24.7463 |
| 1957 | 21.5266 | | 1957 | 25.027 |
| 1956 | 21.5258 | | 1956 | 24.773 |
| 1955 | 21.5415 | | 1955 | 24.7675 |
| 1954 | 21.3398 | | 1954 | 24.653 |
| 1953 | 21.217 | | 1953 | 24.633 |
| 1952 | 21.2972 | | 1952 | 24.7737 |
| 1951 | 21.2375 | | 1951 | 24.703 |
| 1950 | 21.2332 | | 1950 | 24.6199 |
| 1949 | 21.3206 | | 1949 | 24.7608 |
| 1948 | 21.0799 | | 1948 | 24.6995 |
| 1947 | 21.2923 | | 1947 | 24.8988 |
| 1946 | 21.4834 | | 1946 | 25.022 |
| 1945 | 21.4328 | | 1945 | 24.9274 |
| 1944 | 21.5766 | | 1944 | 24.9309 |
| 1943 | 21.4537 | | 1943 | 24.5683 |
| 1942 | 21.3339 | | 1942 | 24.6215 |

FIG. 25

| Tape in black | | | Tape in white | |
|---|---|---|---|---|
| Wavelength (μm) | Light transmittance T (%) | | Wavelength (μm) | Light transmittance T (%) |
| 1941 | 21.4006 | | 1941 | 24.7051 |
| 1940 | 21.0915 | | 1940 | 24.6533 |
| 1939 | 20.8588 | | 1939 | 24.759 |
| 1938 | 20.9445 | | 1938 | 24.799 |
| 1937 | 21.1827 | | 1937 | 24.838 |
| 1936 | 21.4243 | | 1936 | 24.6959 |
| 1935 | 21.6742 | | 1935 | 24.8704 |
| 1934 | 21.6741 | | 1934 | 24.779 |
| 1933 | 21.5097 | | 1933 | 24.7467 |
| 1932 | 21.3606 | | 1932 | 24.6701 |
| 1931 | 21.2925 | | 1931 | 24.5067 |
| 1930 | 21.024 | | 1930 | 24.3102 |
| 1929 | 21.0434 | | 1929 | 24.4785 |
| 1928 | 21.1717 | | 1928 | 24.7671 |
| 1927 | 21.2591 | | 1927 | 24.9314 |
| 1926 | 21.7043 | | 1926 | 25.4041 |
| 1925 | 21.6021 | | 1925 | 25.1286 |
| 1924 | 21.5362 | | 1924 | 25.0402 |
| 1923 | 21.4829 | | 1923 | 24.9174 |
| 1922 | 21.2538 | | 1922 | 24.701 |
| 1921 | 21.3979 | | 1921 | 24.7563 |
| 1920 | 21.2423 | | 1920 | 24.5728 |
| 1919 | 21.1616 | | 1919 | 24.7628 |
| 1918 | 21.2155 | | 1918 | 24.7965 |
| 1917 | 20.9734 | | 1917 | 24.6356 |
| 1916 | 21.1923 | | 1916 | 24.8685 |
| 1915 | 21.1104 | | 1915 | 24.6923 |
| 1914 | 21.0669 | | 1914 | 24.809 |

FIG. 26

| Tape in black | | | Tape in white | |
|---|---|---|---|---|
| Wavelength (μm) | Light transmittance T (%) | | Wavelength (μm) | Light transmittance T (%) |
| 1913 | 21.1681 | | 1913 | 24.97 |
| 1912 | 21.1772 | | 1912 | 24.9326 |
| 1911 | 21.1337 | | 1911 | 24.8689 |
| 1910 | 21.1592 | | 1910 | 24.7287 |
| 1909 | 21.1089 | | 1909 | 24.7336 |
| 1908 | 21.0951 | | 1908 | 24.8697 |
| 1907 | 21.3047 | | 1907 | 25.0031 |
| 1906 | 21.2821 | | 1906 | 25.1329 |
| 1905 | 21.3778 | | 1905 | 25.2247 |
| 1904 | 21.5506 | | 1904 | 25.1587 |
| 1903 | 21.4111 | | 1903 | 25.1876 |
| 1902 | 21.1554 | | 1902 | 25.0332 |
| 1901 | 21.2555 | | 1901 | 25.0907 |
| 1900 | 21.4408 | | 1900 | 25.1434 |
| 1899 | 21.4826 | | 1899 | 25.2486 |
| 1898 | 21.6029 | | 1898 | 25.3284 |
| 1897 | 21.7249 | | 1897 | 25.4373 |
| 1896 | 21.5431 | | 1896 | 25.2631 |
| 1895 | 21.6422 | | 1895 | 25.3051 |
| 1894 | 21.4903 | | 1894 | 25.1655 |
| 1893 | 21.3753 | | 1893 | 24.9502 |
| 1892 | 21.6422 | | 1892 | 25.0706 |
| 1891 | 21.6542 | | 1891 | 24.9753 |
| 1890 | 21.8053 | | 1890 | 25.0701 |
| 1889 | 21.8711 | | 1889 | 25.0434 |
| 1888 | 21.6653 | | 1888 | 25.0441 |
| 1887 | 21.6383 | | 1887 | 25.0535 |
| 1886 | 21.4899 | | 1886 | 25.0099 |

FIG. 27

| Tape in black | | | Tape in white | |
|---|---|---|---|---|
| Wavelength (μm) | Light transmittance T (%) | | Wavelength (μm) | Light transmittance T (%) |
| 1885 | 21.4702 | | 1885 | 25.0359 |
| 1884 | 21.5366 | | 1884 | 25.0733 |
| 1883 | 21.4699 | | 1883 | 25.0886 |
| 1882 | 21.5176 | | 1882 | 25.089 |
| 1881 | 21.5031 | | 1881 | 25.0273 |
| 1880 | 21.456 | | 1880 | 25.0697 |
| 1879 | 21.4424 | | 1879 | 25.0308 |
| 1878 | 21.3433 | | 1878 | 24.9266 |
| 1877 | 21.3959 | | 1877 | 25.0396 |
| 1876 | 21.4535 | | 1876 | 24.8529 |
| 1875 | 21.485 | | 1875 | 24.8787 |
| 1874 | 21.6129 | | 1874 | 24.9298 |
| 1873 | 21.5378 | | 1873 | 24.9067 |
| 1872 | 21.5788 | | 1872 | 25.0131 |
| 1871 | 21.5897 | | 1871 | 24.8682 |
| 1870 | 21.5482 | | 1870 | 24.9319 |
| 1869 | 21.3987 | | 1869 | 24.7877 |
| 1868 | 21.2545 | | 1868 | 24.7042 |
| 1867 | 21.1184 | | 1867 | 24.9215 |
| 1866 | 21.1051 | | 1866 | 24.8658 |
| 1865 | 21.2395 | | 1865 | 25.0456 |
| 1864 | 21.288 | | 1864 | 25.0659 |
| 1863 | 21.3768 | | 1863 | 24.9638 |
| 1862 | 21.3051 | | 1862 | 24.9847 |
| 1861 | 21.2309 | | 1861 | 24.9013 |
| 1860 | 21.2488 | | 1860 | 24.9878 |
| 1859 | 21.2235 | | 1859 | 24.9658 |
| 1858 | 21.2741 | | 1858 | 24.955 |

FIG. 28

| Tape in black | | | Tape in white | |
|---|---|---|---|---|
| Wavelength (μm) | Light transmittance T (%) | | Wavelength (μm) | Light transmittance T (%) |
| 1857 | 21.4194 | | 1857 | 24.9248 |
| 1856 | 21.4783 | | 1856 | 24.8845 |
| 1855 | 21.4882 | | 1855 | 24.9545 |
| 1854 | 21.557 | | 1854 | 25.0132 |
| 1853 | 21.4707 | | 1853 | 24.9974 |
| 1852 | 21.4236 | | 1852 | 24.9654 |
| 1851 | 21.4167 | | 1851 | 24.8799 |
| 1850 | 21.1914 | | 1850 | 24.8133 |
| 1849 | 21.336 | | 1849 | 24.9458 |
| 1848 | 21.2787 | | 1848 | 24.9886 |
| 1847 | 21.3297 | | 1847 | 25.1078 |
| 1846 | 21.4755 | | 1846 | 25.134 |
| 1845 | 21.3613 | | 1845 | 25.1093 |
| 1844 | 21.4046 | | 1844 | 25.0256 |
| 1843 | 21.3526 | | 1843 | 24.9892 |
| 1842 | 21.3622 | | 1842 | 24.9816 |
| 1841 | 21.3688 | | 1841 | 24.8762 |
| 1840 | 21.3733 | | 1840 | 24.9093 |
| 1839 | 21.3745 | | 1839 | 24.8216 |
| 1838 | 21.372 | | 1838 | 24.7867 |
| 1837 | 21.3399 | | 1837 | 24.793 |
| 1836 | 21.3009 | | 1836 | 24.8382 |
| 1835 | 21.3148 | | 1835 | 24.8431 |
| 1834 | 21.4117 | | 1834 | 24.9222 |
| 1833 | 21.4174 | | 1833 | 24.9568 |
| 1832 | 21.5124 | | 1832 | 24.9545 |
| 1831 | 21.512 | | 1831 | 24.9602 |
| 1830 | 21.3904 | | 1830 | 24.8363 |

FIG. 29

| Tape in black | | | Tape in white | |
|---|---|---|---|---|
| Wavelength (μm) | Light transmittance T (%) | | Wavelength (μm) | Light transmittance T (%) |
| 1829 | 21.4519 | | 1829 | 24.8368 |
| 1828 | 21.4509 | | 1828 | 24.9001 |
| 1827 | 21.4569 | | 1827 | 24.9266 |
| 1826 | 21.5329 | | 1826 | 24.9766 |
| 1825 | 21.4814 | | 1825 | 24.97 |
| 1824 | 21.3931 | | 1824 | 24.9179 |
| 1823 | 21.4217 | | 1823 | 24.9714 |
| 1822 | 21.3642 | | 1822 | 25.01 |
| 1821 | 21.3855 | | 1821 | 25.0839 |
| 1820 | 21.3673 | | 1820 | 25.0277 |
| 1819 | 21.3519 | | 1819 | 25.028 |
| 1818 | 21.3739 | | 1818 | 24.989 |
| 1817 | 21.4063 | | 1817 | 24.9106 |
| 1816 | 21.408 | | 1816 | 24.9117 |
| 1815 | 21.4511 | | 1815 | 24.8954 |
| 1814 | 21.4247 | | 1814 | 24.9279 |
| 1813 | 21.4212 | | 1813 | 24.9577 |
| 1812 | 21.5235 | | 1812 | 24.9922 |
| 1811 | 21.4695 | | 1811 | 24.9536 |
| 1810 | 21.5783 | | 1810 | 24.961 |
| 1809 | 21.6174 | | 1809 | 24.9625 |
| 1808 | 21.5926 | | 1808 | 25.001 |
| 1807 | 21.6359 | | 1807 | 25.003 |
| 1806 | 21.5098 | | 1806 | 24.9134 |
| 1805 | 21.4947 | | 1805 | 24.9349 |
| 1804 | 21.5428 | | 1804 | 24.9886 |
| 1803 | 21.4879 | | 1803 | 25.0366 |
| 1802 | 21.5612 | | 1802 | 25.1413 |

FIG. 30

| Tape in black | | | Tape in white | |
|---|---|---|---|---|
| Wavelength (μm) | Light transmittance T (%) | | Wavelength (μm) | Light transmittance T (%) |
| 1801 | 21.515 | | 1801 | 25.1636 |
| 1800 | 21.5305 | | 1800 | 25.1118 |
| 1799 | 21.648 | | 1799 | 25.1387 |
| 1798 | 21.6547 | | 1798 | 25.1578 |
| 1797 | 21.6736 | | 1797 | 25.1266 |
| 1796 | 21.6123 | | 1796 | 25.0772 |
| 1795 | 21.5264 | | 1795 | 25.059 |
| 1794 | 21.4879 | | 1794 | 25.0096 |
| 1793 | 21.5071 | | 1793 | 24.991 |
| 1792 | 21.5058 | | 1792 | 25.0102 |
| 1791 | 21.5538 | | 1791 | 24.9934 |
| 1790 | 21.5752 | | 1790 | 25.0742 |
| 1789 | 21.5731 | | 1789 | 25.1193 |
| 1788 | 21.6523 | | 1788 | 25.1171 |
| 1787 | 21.6297 | | 1787 | 25.1165 |
| 1786 | 21.647 | | 1786 | 25.0664 |
| 1785 | 21.6494 | | 1785 | 25.0668 |
| 1784 | 21.6281 | | 1784 | 25.1342 |
| 1783 | 21.6259 | | 1783 | 25.113 |
| 1782 | 21.6312 | | 1782 | 25.0494 |
| 1781 | 21.5584 | | 1781 | 25.0008 |
| 1780 | 21.4868 | | 1780 | 24.9038 |
| 1779 | 21.4692 | | 1779 | 24.9672 |
| 1778 | 21.4364 | | 1778 | 24.9881 |
| 1777 | 21.4909 | | 1777 | 25.0497 |
| 1776 | 21.5069 | | 1776 | 25.0889 |
| 1775 | 21.4982 | | 1775 | 25.0708 |
| 1774 | 21.5701 | | 1774 | 25.1242 |

FIG. 31

| Tape in black | | | Tape in white | |
|---|---|---|---|---|
| Wavelength (μm) | Light transmittance T (%) | | Wavelength (μm) | Light transmittance T (%) |
| 1773 | 21.6058 | | 1773 | 25.112 |
| 1772 | 21.6593 | | 1772 | 25.1198 |
| 1771 | 21.6548 | | 1771 | 25.04 |
| 1770 | 21.5662 | | 1770 | 24.9756 |
| 1769 | 21.5506 | | 1769 | 24.9833 |
| 1768 | 21.5329 | | 1768 | 24.9787 |
| 1767 | 21.5638 | | 1767 | 25.0205 |
| 1766 | 21.5737 | | 1766 | 25.0414 |
| 1765 | 21.5358 | | 1765 | 25.0413 |
| 1764 | 21.5528 | | 1764 | 25.0751 |
| 1763 | 21.498 | | 1763 | 25.0151 |
| 1762 | 21.4679 | | 1762 | 25.0242 |
| 1761 | 21.4615 | | 1761 | 25.0143 |
| 1760 | 21.4428 | | 1760 | 25.0069 |
| 1759 | 21.4817 | | 1759 | 25.0735 |
| 1758 | 21.5252 | | 1758 | 25.1056 |
| 1757 | 21.5444 | | 1757 | 25.0907 |
| 1756 | 21.5583 | | 1756 | 25.0835 |
| 1755 | 21.5516 | | 1755 | 25.1008 |
| 1754 | 21.5673 | | 1754 | 25.0763 |
| 1753 | 21.5945 | | 1753 | 25.103 |
| 1752 | 21.5034 | | 1752 | 25.0621 |
| 1751 | 21.4953 | | 1751 | 25.085 |
| 1750 | 21.4608 | | 1750 | 25.0477 |
| 1749 | 21.4568 | | 1749 | 25.0204 |
| 1748 | 21.5268 | | 1748 | 25.0565 |
| 1747 | 21.5361 | | 1747 | 25.0079 |
| 1746 | 21.5595 | | 1746 | 24.9548 |

FIG. 32

| Tape in black | | | Tape in white | |
|---|---|---|---|---|
| Wavelength (μm) | Light transmittance T (%) | | Wavelength (μm) | Light transmittance T (%) |
| 1745 | 21.548 | | 1745 | 24.9452 |
| 1744 | 21.544 | | 1744 | 24.9437 |
| 1743 | 21.5781 | | 1743 | 24.9689 |
| 1742 | 21.5496 | | 1742 | 25.0158 |
| 1741 | 21.5172 | | 1741 | 25.0322 |
| 1740 | 21.5031 | | 1740 | 24.9727 |
| 1739 | 21.4512 | | 1739 | 24.9416 |
| 1738 | 21.4167 | | 1738 | 24.9829 |
| 1737 | 21.3937 | | 1737 | 24.9437 |
| 1736 | 21.3687 | | 1736 | 25.0074 |
| 1735 | 21.3829 | | 1735 | 25.0042 |
| 1734 | 21.4738 | | 1734 | 25.0181 |
| 1733 | 21.4697 | | 1733 | 25.0185 |
| 1732 | 21.4432 | | 1732 | 24.977 |
| 1731 | 21.4252 | | 1731 | 24.9877 |
| 1730 | 21.399 | | 1730 | 24.9378 |
| 1729 | 21.4046 | | 1729 | 24.9457 |
| 1728 | 21.4366 | | 1728 | 24.9759 |
| 1727 | 21.4524 | | 1727 | 24.9718 |
| 1726 | 21.3466 | | 1726 | 24.9845 |
| 1725 | 21.3439 | | 1725 | 24.9541 |
| 1724 | 21.3039 | | 1724 | 24.9351 |
| 1723 | 21.2334 | | 1723 | 24.8937 |
| 1722 | 21.3122 | | 1722 | 24.9518 |
| 1721 | 21.3891 | | 1721 | 24.9565 |
| 1720 | 21.41 | | 1720 | 24.9396 |
| 1719 | 21.4588 | | 1719 | 25.0134 |
| 1718 | 21.4493 | | 1718 | 24.9329 |

FIG. 33

| Tape in black | | | Tape in white | |
|---|---|---|---|---|
| Wavelength (μm) | Light transmittance T (%) | | Wavelength (μm) | Light transmittance T (%) |
| 1717 | 21.3777 | | 1717 | 24.9685 |
| 1716 | 21.3654 | | 1716 | 25.0025 |
| 1715 | 21.3841 | | 1715 | 24.9996 |
| 1714 | 21.3461 | | 1714 | 25.0229 |
| 1713 | 21.3801 | | 1713 | 25.0315 |
| 1712 | 21.3666 | | 1712 | 24.9594 |
| 1711 | 21.343 | | 1711 | 24.9212 |
| 1710 | 21.3892 | | 1710 | 24.9402 |
| 1709 | 21.3709 | | 1709 | 24.971 |
| 1708 | 21.3678 | | 1708 | 24.9768 |
| 1707 | 21.3624 | | 1707 | 24.9773 |
| 1706 | 21.3933 | | 1706 | 24.9599 |
| 1705 | 21.3822 | | 1705 | 24.9167 |
| 1704 | 21.4226 | | 1704 | 24.9873 |
| 1703 | 21.4438 | | 1703 | 24.9836 |
| 1702 | 21.4248 | | 1702 | 24.9446 |
| 1701 | 21.4033 | | 1701 | 24.9482 |
| 1700 | 21.4082 | | 1700 | 24.936 |
| 1699 | 21.4503 | | 1699 | 24.9891 |
| 1698 | 21.4727 | | 1698 | 25.0849 |
| 1697 | 21.5138 | | 1697 | 25.0455 |
| 1696 | 21.5269 | | 1696 | 25.0267 |
| 1695 | 21.5255 | | 1695 | 25.0657 |
| 1694 | 21.4569 | | 1694 | 24.9946 |
| 1693 | 21.4173 | | 1693 | 24.9993 |
| 1692 | 21.4825 | | 1692 | 25.0432 |
| 1691 | 21.482 | | 1691 | 24.9753 |
| 1690 | 21.5421 | | 1690 | 24.9761 |

FIG. 34

| Tape in black | | | Tape in white | |
|---|---|---|---|---|
| Wavelength (μm) | Light transmittance T (%) | | Wavelength (μm) | Light transmittance T (%) |
| 1689 | 21.5864 | | 1689 | 25.0317 |
| 1688 | 21.5136 | | 1688 | 25.0425 |
| 1687 | 21.5025 | | 1687 | 25.0822 |
| 1686 | 21.4839 | | 1686 | 25.0989 |
| 1685 | 21.5021 | | 1685 | 25.0826 |
| 1684 | 21.5173 | | 1684 | 25.0453 |
| 1683 | 21.5337 | | 1683 | 25.0077 |
| 1682 | 21.5313 | | 1682 | 25.0094 |
| 1681 | 21.5306 | | 1681 | 25.0221 |
| 1680 | 21.5323 | | 1680 | 25.0562 |
| 1679 | 21.4511 | | 1679 | 25.0481 |
| 1678 | 21.4604 | | 1678 | 25.029 |
| 1677 | 21.4186 | | 1677 | 24.9907 |
| 1676 | 21.3868 | | 1676 | 24.9569 |
| 1675 | 21.4639 | | 1675 | 25.0073 |
| 1674 | 21.4881 | | 1674 | 25.0483 |
| 1673 | 21.5227 | | 1673 | 25.0905 |
| 1672 | 21.5122 | | 1672 | 25.0409 |
| 1671 | 21.4362 | | 1671 | 24.9785 |
| 1670 | 21.3969 | | 1670 | 24.9686 |
| 1669 | 21.4185 | | 1669 | 25.0333 |
| 1668 | 21.4329 | | 1668 | 25.0735 |
| 1667 | 21.4691 | | 1667 | 25.0755 |
| 1666 | 21.4841 | | 1666 | 25.0521 |
| 1665 | 21.4642 | | 1665 | 25.0251 |
| 1664 | 21.4871 | | 1664 | 25.0824 |
| 1663 | 21.5143 | | 1663 | 25.0971 |
| 1662 | 21.5215 | | 1662 | 25.1366 |

FIG. 35

| Tape in black | | | Tape in white | |
|---|---|---|---|---|
| Wavelength (μm) | Light transmittance T (%) | | Wavelength (μm) | Light transmittance T (%) |
| 1661 | 21.542 | | 1661 | 25.1016 |
| 1660 | 21.5579 | | 1660 | 25.0665 |
| 1659 | 21.5004 | | 1659 | 25.0593 |
| 1658 | 21.4443 | | 1658 | 25.0323 |
| 1657 | 21.4431 | | 1657 | 25.0011 |
| 1656 | 21.4056 | | 1656 | 24.975 |
| 1655 | 21.4855 | | 1655 | 25.0206 |
| 1654 | 21.4896 | | 1654 | 25.0343 |
| 1653 | 21.4309 | | 1653 | 25.0334 |
| 1652 | 21.4212 | | 1652 | 25.0003 |
| 1651 | 21.409 | | 1651 | 25.0117 |
| 1650 | 21.4512 | | 1650 | 24.981 |
| 1649 | 21.4512 | | 1649 | 24.9707 |
| 1648 | 21.445 | | 1648 | 25.0022 |
| 1647 | 21.4106 | | 1647 | 24.9284 |
| 1646 | 21.4475 | | 1646 | 24.9811 |
| 1645 | 21.4456 | | 1645 | 25.0156 |
| 1644 | 21.5086 | | 1644 | 25.053 |
| 1643 | 21.5434 | | 1643 | 25.1179 |
| 1642 | 21.509 | | 1642 | 25.0157 |
| 1641 | 21.5234 | | 1641 | 24.989 |
| 1640 | 21.5217 | | 1640 | 24.9714 |
| 1639 | 21.5011 | | 1639 | 24.9152 |
| 1638 | 21.4449 | | 1638 | 24.9777 |
| 1637 | 21.4685 | | 1637 | 25.005 |
| 1636 | 21.468 | | 1636 | 25.027 |
| 1635 | 21.4637 | | 1635 | 25.0628 |
| 1634 | 21.5137 | | 1634 | 25.0576 |

FIG. 36

| Tape in black | | | Tape in white | |
|---|---|---|---|---|
| Wavelength (μm) | Light transmittance T (%) | | Wavelength (μm) | Light transmittance T (%) |
| 1633 | 21.4776 | | 1633 | 25.0669 |
| 1632 | 21.4183 | | 1632 | 25.0408 |
| 1631 | 21.4423 | | 1631 | 25.0489 |
| 1630 | 21.4464 | | 1630 | 25.0482 |
| 1629 | 21.5037 | | 1629 | 25.0512 |
| 1628 | 21.5103 | | 1628 | 25.0352 |
| 1627 | 21.5169 | | 1627 | 25.0683 |
| 1626 | 21.5616 | | 1626 | 25.1372 |
| 1625 | 21.5148 | | 1625 | 25.0855 |
| 1624 | 21.4918 | | 1624 | 25.1174 |
| 1623 | 21.4264 | | 1623 | 25.0601 |
| 1622 | 21.3572 | | 1622 | 25.0099 |
| 1621 | 21.3752 | | 1621 | 25.0461 |
| 1620 | 21.4278 | | 1620 | 25.0288 |
| 1619 | 21.4618 | | 1619 | 25.0322 |
| 1618 | 21.4928 | | 1618 | 25.0306 |
| 1617 | 21.5163 | | 1617 | 25.051 |
| 1616 | 21.5052 | | 1616 | 25.052 |
| 1615 | 21.4938 | | 1615 | 25.0539 |
| 1614 | 21.4616 | | 1614 | 25.0489 |
| 1613 | 21.433 | | 1613 | 25.0295 |
| 1612 | 21.4221 | | 1612 | 25.0475 |
| 1611 | 21.4406 | | 1611 | 25.0623 |
| 1610 | 21.4593 | | 1610 | 25.0136 |
| 1609 | 21.4785 | | 1609 | 25.0324 |
| 1608 | 21.466 | | 1608 | 24.994 |
| 1607 | 21.5115 | | 1607 | 25.0144 |
| 1606 | 21.5317 | | 1606 | 25.0678 |

FIG. 37

| Tape in black | | | Tape in white | |
|---|---|---|---|---|
| Wavelength (μm) | Light transmittance T (%) | | Wavelength (μm) | Light transmittance T (%) |
| 1605 | 21.5545 | | 1605 | 25.0949 |
| 1604 | 21.597 | | 1604 | 25.1263 |
| 1603 | 21.5148 | | 1603 | 25.0577 |
| 1602 | 21.4856 | | 1602 | 25.0189 |
| 1601 | 21.4853 | | 1601 | 24.9799 |
| 1600 | 21.4519 | | 1600 | 24.9666 |
| 1599 | 21.5169 | | 1599 | 25.0494 |
| 1598 | 21.5601 | | 1598 | 25.1015 |
| 1597 | 21.5258 | | 1597 | 25.1221 |
| 1596 | 21.5351 | | 1596 | 25.1217 |
| 1595 | 21.4795 | | 1595 | 25.0497 |
| 1594 | 21.5093 | | 1594 | 25.0629 |
| 1593 | 21.5491 | | 1593 | 25.0753 |
| 1592 | 21.5914 | | 1592 | 25.101 |
| 1591 | 21.6473 | | 1591 | 25.1495 |
| 1590 | 21.614 | | 1590 | 25.1318 |
| 1589 | 21.5989 | | 1589 | 25.1133 |
| 1588 | 21.5668 | | 1588 | 25.1386 |
| 1587 | 21.542 | | 1587 | 25.1111 |
| 1586 | 21.5301 | | 1586 | 25.0914 |
| 1585 | 21.5215 | | 1585 | 25.0827 |
| 1584 | 21.5215 | | 1584 | 25.0809 |
| 1583 | 21.5553 | | 1583 | 25.1197 |
| 1582 | 21.5546 | | 1582 | 25.1702 |
| 1581 | 21.5276 | | 1581 | 25.1327 |
| 1580 | 21.5637 | | 1580 | 25.1193 |
| 1579 | 21.5391 | | 1579 | 25.0703 |
| 1578 | 21.5386 | | 1578 | 25.0398 |

FIG. 38

| Tape in black | | | Tape in white | |
|---|---|---|---|---|
| Wavelength (μm) | Light transmittance T (%) | | Wavelength (μm) | Light transmittance T (%) |
| 1577 | 21.5653 | | 1577 | 25.1162 |
| 1576 | 21.54 | | 1576 | 25.1298 |
| 1575 | 21.538 | | 1575 | 25.1695 |
| 1574 | 21.5504 | | 1574 | 25.1519 |
| 1573 | 21.565 | | 1573 | 25.1401 |
| 1572 | 21.5346 | | 1572 | 25.089 |
| 1571 | 21.5624 | | 1571 | 25.0729 |
| 1570 | 21.5613 | | 1570 | 25.1165 |
| 1569 | 21.5191 | | 1569 | 25.1151 |
| 1568 | 21.5572 | | 1568 | 25.1614 |
| 1567 | 21.5344 | | 1567 | 25.1848 |
| 1566 | 21.5428 | | 1566 | 25.1556 |
| 1565 | 21.5685 | | 1565 | 25.1467 |
| 1564 | 21.5738 | | 1564 | 25.1497 |
| 1563 | 21.5643 | | 1563 | 25.1017 |
| 1562 | 21.5443 | | 1562 | 25.0984 |
| 1561 | 21.5445 | | 1561 | 25.0743 |
| 1560 | 21.5938 | | 1560 | 25.097 |
| 1559 | 21.6258 | | 1559 | 25.1118 |
| 1558 | 21.6628 | | 1558 | 25.1253 |
| 1557 | 21.7105 | | 1557 | 25.1511 |
| 1556 | 21.6129 | | 1556 | 25.0779 |
| 1555 | 21.5916 | | 1555 | 25.0726 |
| 1554 | 21.6051 | | 1554 | 25.0935 |
| 1553 | 21.5529 | | 1553 | 25.0508 |
| 1552 | 21.6116 | | 1552 | 25.1257 |
| 1551 | 21.6027 | | 1551 | 25.1503 |
| 1550 | 21.5542 | | 1550 | 25.1206 |

FIG. 39

| Tape in black | | | Tape in white | |
|---|---|---|---|---|
| Wavelength (μm) | Light transmittance T (%) | | Wavelength (μm) | Light transmittance T (%) |
| 1549 | 21.5795 | | 1549 | 25.1563 |
| 1548 | 21.5992 | | 1548 | 25.1214 |
| 1547 | 21.5992 | | 1547 | 25.1463 |
| 1546 | 21.5807 | | 1546 | 25.1491 |
| 1545 | 21.5544 | | 1545 | 25.1056 |
| 1544 | 21.5345 | | 1544 | 25.0916 |
| 1543 | 21.5559 | | 1543 | 25.0597 |
| 1542 | 21.5783 | | 1542 | 25.0598 |
| 1541 | 21.6157 | | 1541 | 25.1236 |
| 1540 | 21.6484 | | 1540 | 25.1574 |
| 1539 | 21.6418 | | 1539 | 25.1711 |
| 1538 | 21.6625 | | 1538 | 25.1968 |
| 1537 | 21.6335 | | 1537 | 25.1926 |
| 1536 | 21.5672 | | 1536 | 25.1451 |
| 1535 | 21.5801 | | 1535 | 25.1673 |
| 1534 | 21.5361 | | 1534 | 25.1114 |
| 1533 | 21.5136 | | 1533 | 25.0937 |
| 1532 | 21.5609 | | 1532 | 25.1297 |
| 1531 | 21.5364 | | 1531 | 25.0728 |
| 1530 | 21.542 | | 1530 | 25.1084 |
| 1529 | 21.5721 | | 1529 | 25.1221 |
| 1528 | 21.5337 | | 1528 | 25.1204 |
| 1527 | 21.5186 | | 1527 | 25.1398 |
| 1526 | 21.5321 | | 1526 | 25.1203 |
| 1525 | 21.5322 | | 1525 | 25.1145 |
| 1524 | 21.5521 | | 1524 | 25.0973 |
| 1523 | 21.554 | | 1523 | 25.0857 |
| 1522 | 21.5823 | | 1522 | 25.1341 |

FIG. 40

| Tape in black | | | Tape in white | |
|---|---|---|---|---|
| Wavelength (μm) | Light transmittance T (%) | | Wavelength (μm) | Light transmittance T (%) |
| 1521 | 21.5829 | | 1521 | 25.1041 |
| 1520 | 21.5642 | | 1520 | 25.0825 |
| 1519 | 21.5752 | | 1519 | 25.081 |
| 1518 | 21.5353 | | 1518 | 25.0221 |
| 1517 | 21.5531 | | 1517 | 25.0171 |
| 1516 | 21.5222 | | 1516 | 25.0482 |
| 1515 | 21.5524 | | 1515 | 25.066 |
| 1514 | 21.5702 | | 1514 | 25.0851 |
| 1513 | 21.566 | | 1513 | 25.1168 |
| 1512 | 21.5691 | | 1512 | 25.1047 |
| 1511 | 21.5376 | | 1511 | 25.0909 |
| 1510 | 21.5092 | | 1510 | 25.0571 |
| 1509 | 21.4905 | | 1509 | 25.0554 |
| 1508 | 21.5092 | | 1508 | 25.0605 |
| 1507 | 21.5166 | | 1507 | 25.0474 |
| 1506 | 21.5408 | | 1506 | 25.0868 |
| 1505 | 21.5356 | | 1505 | 25.078 |
| 1504 | 21.5051 | | 1504 | 25.0639 |
| 1503 | 21.5158 | | 1503 | 25.0906 |
| 1502 | 21.5406 | | 1502 | 25.0994 |
| 1501 | 21.5623 | | 1501 | 25.0739 |
| 1500 | 21.5804 | | 1500 | 25.0524 |
| 1499 | 21.628 | | 1499 | 25.0347 |
| 1498 | 21.5901 | | 1498 | 24.9892 |
| 1497 | 21.5682 | | 1497 | 25.0125 |
| 1496 | 21.5784 | | 1496 | 25.0229 |
| 1495 | 21.5329 | | 1495 | 25.044 |
| 1494 | 21.5779 | | 1494 | 25.0695 |

FIG. 41

| Tape in black | | | Tape in white | |
|---|---|---|---|---|
| Wavelength (μm) | Light transmittance T (%) | | Wavelength (μm) | Light transmittance T (%) |
| 1493 | 21.5748 | | 1493 | 25.0489 |
| 1492 | 21.6102 | | 1492 | 25.0822 |
| 1491 | 21.5803 | | 1491 | 25.0799 |
| 1490 | 21.5626 | | 1490 | 25.0924 |
| 1489 | 21.5463 | | 1489 | 25.1028 |
| 1488 | 21.5306 | | 1488 | 25.0816 |
| 1487 | 21.5599 | | 1487 | 25.085 |
| 1486 | 21.5352 | | 1486 | 25.0865 |
| 1485 | 21.5345 | | 1485 | 25.0718 |
| 1484 | 21.5295 | | 1484 | 25.0749 |
| 1483 | 21.5198 | | 1483 | 25.0421 |
| 1482 | 21.5595 | | 1482 | 25.0355 |
| 1481 | 21.5738 | | 1481 | 25.0815 |
| 1480 | 21.5841 | | 1480 | 25.076 |
| 1479 | 21.6107 | | 1479 | 25.1384 |
| 1478 | 21.5496 | | 1478 | 25.099 |
| 1477 | 21.5537 | | 1477 | 25.0728 |
| 1476 | 21.5564 | | 1476 | 25.1121 |
| 1475 | 21.4926 | | 1475 | 25.0596 |
| 1474 | 21.5133 | | 1474 | 25.074 |
| 1473 | 21.5002 | | 1473 | 25.0474 |
| 1472 | 21.5163 | | 1472 | 25.0181 |
| 1471 | 21.5579 | | 1471 | 25.0429 |
| 1470 | 21.5505 | | 1470 | 25.0589 |
| 1469 | 21.5499 | | 1469 | 25.0806 |
| 1468 | 21.4888 | | 1468 | 25.0576 |
| 1467 | 21.4567 | | 1467 | 25.0177 |
| 1466 | 21.445 | | 1466 | 25.0132 |

FIG. 42

| Tape in black | | | Tape in white | |
|---|---|---|---|---|
| Wavelength (μm) | Light transmittance T (%) | | Wavelength (μm) | Light transmittance T (%) |
| 1465 | 21.455 | | 1465 | 25.0211 |
| 1464 | 21.503 | | 1464 | 25.0559 |
| 1463 | 21.5428 | | 1463 | 25.0609 |
| 1462 | 21.5687 | | 1462 | 25.0711 |
| 1461 | 21.5427 | | 1461 | 25.0516 |
| 1460 | 21.526 | | 1460 | 25.0412 |
| 1459 | 21.5279 | | 1459 | 25.0495 |
| 1458 | 21.5194 | | 1458 | 25.0428 |
| 1457 | 21.5227 | | 1457 | 25.0455 |
| 1456 | 21.5401 | | 1456 | 25.0552 |
| 1455 | 21.4974 | | 1455 | 25.0203 |
| 1454 | 21.54 | | 1454 | 25.024 |
| 1453 | 21.5516 | | 1453 | 25.031 |
| 1452 | 21.525 | | 1452 | 25.0156 |
| 1451 | 21.5291 | | 1451 | 25.0521 |
| 1450 | 21.4738 | | 1450 | 25.0526 |
| 1449 | 21.4876 | | 1449 | 25.0726 |
| 1448 | 21.4757 | | 1448 | 25.0577 |
| 1447 | 21.463 | | 1447 | 25.0525 |
| 1446 | 21.5172 | | 1446 | 25.0524 |
| 1445 | 21.4951 | | 1445 | 25.0344 |
| 1444 | 21.534 | | 1444 | 25.018 |
| 1443 | 21.5605 | | 1443 | 25.0127 |
| 1442 | 21.5037 | | 1442 | 25.0094 |
| 1441 | 21.4903 | | 1441 | 24.9761 |
| 1440 | 21.4377 | | 1440 | 24.9793 |
| 1439 | 21.4333 | | 1439 | 25.0039 |
| 1438 | 21.5059 | | 1438 | 25.0186 |

FIG. 43

| Tape in black | | | Tape in white | |
|---|---|---|---|---|
| Wavelength (μm) | Light transmittance T (%) | | Wavelength (μm) | Light transmittance T (%) |
| 1437 | 21.529 | | 1437 | 25.0311 |
| 1436 | 21.5424 | | 1436 | 25.0425 |
| 1435 | 21.5606 | | 1435 | 25.0481 |
| 1434 | 21.4657 | | 1434 | 24.9908 |
| 1433 | 21.4464 | | 1433 | 25.0139 |
| 1432 | 21.4498 | | 1432 | 25.0187 |
| 1431 | 21.4302 | | 1431 | 24.9958 |
| 1430 | 21.4816 | | 1430 | 25.0384 |
| 1429 | 21.4825 | | 1429 | 25.0511 |
| 1428 | 21.4847 | | 1428 | 25.0324 |
| 1427 | 21.4977 | | 1427 | 25.0408 |
| 1426 | 21.479 | | 1426 | 25.0197 |
| 1425 | 21.5028 | | 1425 | 25.0467 |
| 1424 | 21.4996 | | 1424 | 25.0448 |
| 1423 | 21.4928 | | 1423 | 25.0282 |
| 1422 | 21.5322 | | 1422 | 25.0548 |
| 1421 | 21.5182 | | 1421 | 25.0132 |
| 1420 | 21.5279 | | 1420 | 25.0264 |
| 1419 | 21.5299 | | 1419 | 25.0461 |
| 1418 | 21.5222 | | 1418 | 25.041 |
| 1417 | 21.5615 | | 1417 | 25.049 |
| 1416 | 21.5919 | | 1416 | 25.0818 |
| 1415 | 21.592 | | 1415 | 25.0698 |
| 1414 | 21.6213 | | 1414 | 25.0711 |
| 1413 | 21.6084 | | 1413 | 25.0755 |
| 1412 | 21.5935 | | 1412 | 25.0614 |
| 1411 | 21.6131 | | 1411 | 25.0829 |
| 1410 | 21.5737 | | 1410 | 25.0876 |

FIG. 44

| Tape in black | | | Tape in white | |
|---|---|---|---|---|
| Wavelength (μm) | Light transmittance T (%) | | Wavelength (μm) | Light transmittance T (%) |
| 1409 | 21.6005 | | 1409 | 25.0893 |
| 1408 | 21.6061 | | 1408 | 25.125 |
| 1407 | 21.5951 | | 1407 | 25.1227 |
| 1406 | 21.5882 | | 1406 | 25.1334 |
| 1405 | 21.5776 | | 1405 | 25.1592 |
| 1404 | 21.5904 | | 1404 | 25.1558 |
| 1403 | 21.6017 | | 1403 | 25.1742 |
| 1402 | 21.6435 | | 1402 | 25.1903 |
| 1401 | 21.6315 | | 1401 | 25.1666 |
| 1400 | 21.5982 | | 1400 | 25.1478 |
| 1399 | 21.5928 | | 1399 | 25.1054 |
| 1398 | 21.5569 | | 1398 | 25.0789 |
| 1397 | 21.5525 | | 1397 | 25.0811 |
| 1396 | 21.5808 | | 1396 | 25.0859 |
| 1395 | 21.5739 | | 1395 | 25.0989 |
| 1394 | 21.6037 | | 1394 | 25.1153 |
| 1393 | 21.6274 | | 1393 | 25.1332 |
| 1392 | 21.6214 | | 1392 | 25.1318 |
| 1391 | 21.6397 | | 1391 | 25.138 |
| 1390 | 21.6307 | | 1390 | 25.1302 |
| 1389 | 21.6193 | | 1389 | 25.1124 |
| 1388 | 21.6213 | | 1388 | 25.116 |
| 1387 | 21.5947 | | 1387 | 25.135 |
| 1386 | 21.6102 | | 1386 | 25.1562 |
| 1385 | 21.6373 | | 1385 | 25.1863 |
| 1384 | 21.6353 | | 1384 | 25.1994 |
| 1383 | 21.6734 | | 1383 | 25.2154 |
| 1382 | 21.6609 | | 1382 | 25.2227 |

FIG. 45

| Tape in black | | | Tape in white | |
|---|---|---|---|---|
| Wavelength (μm) | Light transmittance T (%) | | Wavelength (μm) | Light transmittance T (%) |
| 1381 | 21.6783 | | 1381 | 25.2145 |
| 1380 | 21.7003 | | 1380 | 25.2359 |
| 1379 | 21.6928 | | 1379 | 25.2061 |
| 1378 | 21.7086 | | 1378 | 25.2249 |
| 1377 | 21.6623 | | 1377 | 25.2306 |
| 1376 | 21.6632 | | 1376 | 25.2287 |
| 1375 | 21.6922 | | 1375 | 25.2726 |
| 1374 | 21.6866 | | 1374 | 25.2354 |
| 1373 | 21.6948 | | 1373 | 25.2275 |
| 1372 | 21.7095 | | 1372 | 25.2699 |
| 1371 | 21.6939 | | 1371 | 25.2802 |
| 1370 | 21.7195 | | 1370 | 25.3332 |
| 1369 | 21.7608 | | 1369 | 25.3521 |
| 1368 | 21.7347 | | 1368 | 25.3169 |
| 1367 | 21.7501 | | 1367 | 25.3205 |
| 1366 | 21.7432 | | 1366 | 25.3088 |
| 1365 | 21.7054 | | 1365 | 25.3119 |
| 1364 | 21.7485 | | 1364 | 25.3118 |
| 1363 | 21.7467 | | 1363 | 25.3047 |
| 1362 | 21.7567 | | 1362 | 25.3018 |
| 1361 | 21.7668 | | 1361 | 25.2984 |
| 1360 | 21.7463 | | 1360 | 25.3127 |
| 1359 | 21.7382 | | 1359 | 25.3115 |
| 1358 | 21.7181 | | 1358 | 25.3154 |
| 1357 | 21.7397 | | 1357 | 25.3181 |
| 1356 | 21.7179 | | 1356 | 25.2853 |
| 1355 | 21.709 | | 1355 | 25.265 |
| 1354 | 21.7143 | | 1354 | 25.2553 |

FIG. 46

| Tape in black | | | Tape in white | |
|---|---|---|---|---|
| Wavelength (μm) | Light transmittance T (%) | | Wavelength (μm) | Light transmittance T (%) |
| 1353 | 21.6977 | | 1353 | 25.259 |
| 1352 | 21.7052 | | 1352 | 25.2662 |
| 1351 | 21.7031 | | 1351 | 25.2771 |
| 1350 | 21.7064 | | 1350 | 25.2896 |
| 1349 | 21.7197 | | 1349 | 25.2895 |
| 1348 | 21.7398 | | 1348 | 25.2985 |
| 1347 | 21.7562 | | 1347 | 25.2915 |
| 1346 | 21.7474 | | 1346 | 25.2771 |
| 1345 | 21.7494 | | 1345 | 25.2754 |
| 1344 | 21.7386 | | 1344 | 25.2652 |
| 1343 | 21.7322 | | 1343 | 25.28 |
| 1342 | 21.7532 | | 1342 | 25.2886 |
| 1341 | 21.7196 | | 1341 | 25.2857 |
| 1340 | 21.7043 | | 1340 | 25.2886 |
| 1339 | 21.6898 | | 1339 | 25.2834 |
| 1338 | 21.6555 | | 1338 | 25.2528 |
| 1337 | 21.6799 | | 1337 | 25.2458 |
| 1336 | 21.6912 | | 1336 | 25.2606 |
| 1335 | 21.7226 | | 1335 | 25.2636 |
| 1334 | 21.7489 | | 1334 | 25.2737 |
| 1333 | 21.7518 | | 1333 | 25.258 |
| 1332 | 21.7527 | | 1332 | 25.2214 |
| 1331 | 21.7296 | | 1331 | 25.2148 |
| 1330 | 21.7259 | | 1330 | 25.2304 |
| 1329 | 21.7086 | | 1329 | 25.2489 |
| 1328 | 21.7121 | | 1328 | 25.2723 |
| 1327 | 21.6991 | | 1327 | 25.2566 |
| 1326 | 21.6719 | | 1326 | 25.2483 |

FIG. 47

| Tape in black | | | Tape in white | |
|---|---|---|---|---|
| Wavelength (μm) | Light transmittance T (%) | | Wavelength (μm) | Light transmittance T (%) |
| 1325 | 21.6906 | | 1325 | 25.2494 |
| 1324 | 21.7019 | | 1324 | 25.2371 |
| 1323 | 21.705 | | 1323 | 25.2142 |
| 1322 | 21.7234 | | 1322 | 25.1828 |
| 1321 | 21.7117 | | 1321 | 25.1611 |
| 1320 | 21.6893 | | 1320 | 25.1596 |
| 1319 | 21.6969 | | 1319 | 25.1989 |
| 1318 | 21.7038 | | 1318 | 25.2298 |
| 1317 | 21.6844 | | 1317 | 25.2415 |
| 1316 | 21.6985 | | 1316 | 25.2321 |
| 1315 | 21.6836 | | 1315 | 25.2119 |
| 1314 | 21.6583 | | 1314 | 25.1853 |
| 1313 | 21.6631 | | 1313 | 25.174 |
| 1312 | 21.6542 | | 1312 | 25.1855 |
| 1311 | 21.6635 | | 1311 | 25.1785 |
| 1310 | 21.6729 | | 1310 | 25.1972 |
| 1309 | 21.6697 | | 1309 | 25.185 |
| 1308 | 21.6533 | | 1308 | 25.1755 |
| 1307 | 21.6464 | | 1307 | 25.171 |
| 1306 | 21.6302 | | 1306 | 25.1488 |
| 1305 | 21.66 | | 1305 | 25.1778 |
| 1304 | 21.659 | | 1304 | 25.1803 |
| 1303 | 21.6747 | | 1303 | 25.2062 |
| 1302 | 21.6849 | | 1302 | 25.1953 |
| 1301 | 21.666 | | 1301 | 25.1792 |
| 1300 | 21.6936 | | 1300 | 25.1739 |
| 1299 | 21.6685 | | 1299 | 25.1673 |
| 1298 | 21.6731 | | 1298 | 25.1782 |

FIG. 48

| Tape in black | | | Tape in white | |
|---|---|---|---|---|
| Wavelength (μm) | Light transmittance T (%) | | Wavelength (μm) | Light transmittance T (%) |
| 1297 | 21.6505 | | 1297 | 25.1482 |
| 1296 | 21.6388 | | 1296 | 25.1527 |
| 1295 | 21.6548 | | 1295 | 25.1294 |
| 1294 | 21.656 | | 1294 | 25.1232 |
| 1293 | 21.6518 | | 1293 | 25.13 |
| 1292 | 21.6396 | | 1292 | 25.1404 |
| 1291 | 21.623 | | 1291 | 25.1539 |
| 1290 | 21.6283 | | 1290 | 25.1749 |
| 1289 | 21.6272 | | 1289 | 25.1664 |
| 1288 | 21.618 | | 1288 | 25.1493 |
| 1287 | 21.6256 | | 1287 | 25.1406 |
| 1286 | 21.6192 | | 1286 | 25.1363 |
| 1285 | 21.6303 | | 1285 | 25.1599 |
| 1284 | 21.6298 | | 1284 | 25.1561 |
| 1283 | 21.6384 | | 1283 | 25.1558 |
| 1282 | 21.6303 | | 1282 | 25.15 |
| 1281 | 21.6529 | | 1281 | 25.1425 |
| 1280 | 21.6644 | | 1280 | 25.1496 |
| 1279 | 21.6422 | | 1279 | 25.1568 |
| 1278 | 21.6397 | | 1278 | 25.1343 |
| 1277 | 21.6224 | | 1277 | 25.1288 |
| 1276 | 21.5941 | | 1276 | 25.0972 |
| 1275 | 21.6056 | | 1275 | 25.0904 |
| 1274 | 21.6172 | | 1274 | 25.1165 |
| 1273 | 21.6212 | | 1273 | 25.1158 |
| 1272 | 21.6569 | | 1272 | 25.1532 |
| 1271 | 21.6462 | | 1271 | 25.1312 |
| 1270 | 21.6296 | | 1270 | 25.1032 |

FIG. 49

| Tape in black | | | Tape in white | |
|---|---|---|---|---|
| Wavelength (μm) | Light transmittance T (%) | | Wavelength (μm) | Light transmittance T (%) |
| 1269 | 21.6239 | | 1269 | 25.1122 |
| 1268 | 21.6119 | | 1268 | 25.1116 |
| 1267 | 21.6224 | | 1267 | 25.1175 |
| 1266 | 21.614 | | 1266 | 25.1174 |
| 1265 | 21.5989 | | 1265 | 25.0947 |
| 1264 | 21.6034 | | 1264 | 25.0698 |
| 1263 | 21.5881 | | 1263 | 25.0748 |
| 1262 | 21.595 | | 1262 | 25.0729 |
| 1261 | 21.604 | | 1261 | 25.0867 |
| 1260 | 21.6041 | | 1260 | 25.0813 |
| 1259 | 21.6246 | | 1259 | 25.0897 |
| 1258 | 21.6257 | | 1258 | 25.1007 |
| 1257 | 21.631 | | 1257 | 25.0973 |
| 1256 | 21.6373 | | 1256 | 25.1061 |
| 1255 | 21.6218 | | 1255 | 25.0767 |
| 1254 | 21.6123 | | 1254 | 25.0736 |
| 1253 | 21.6185 | | 1253 | 25.0787 |
| 1252 | 21.6211 | | 1252 | 25.0819 |
| 1251 | 21.6583 | | 1251 | 25.1207 |
| 1250 | 21.6904 | | 1250 | 25.1442 |
| 1249 | 21.6875 | | 1249 | 25.1482 |
| 1248 | 21.6774 | | 1248 | 25.1727 |
| 1247 | 21.6538 | | 1247 | 25.1667 |
| 1246 | 21.6637 | | 1246 | 25.1814 |
| 1245 | 21.6781 | | 1245 | 25.1862 |
| 1244 | 21.6926 | | 1244 | 25.1835 |
| 1243 | 21.7148 | | 1243 | 25.2056 |
| 1242 | 21.7045 | | 1242 | 25.2007 |

FIG. 50

| Tape in black | | | Tape in white | |
|---|---|---|---|---|
| Wavelength (μm) | Light transmittance T (%) | | Wavelength (μm) | Light transmittance T (%) |
| 1241 | 21.7013 | | 1241 | 25.2223 |
| 1240 | 21.6967 | | 1240 | 25.2142 |
| 1239 | 21.7082 | | 1239 | 25.2213 |
| 1238 | 21.721 | | 1238 | 25.2238 |
| 1237 | 21.7363 | | 1237 | 25.2029 |
| 1236 | 21.7348 | | 1236 | 25.2072 |
| 1235 | 21.7212 | | 1235 | 25.1983 |
| 1234 | 21.7032 | | 1234 | 25.2162 |
| 1233 | 21.6839 | | 1233 | 25.2285 |
| 1232 | 21.6879 | | 1232 | 25.2178 |
| 1231 | 21.6878 | | 1231 | 25.2234 |
| 1230 | 21.6961 | | 1230 | 25.2127 |
| 1229 | 21.6896 | | 1229 | 25.2091 |
| 1228 | 21.6997 | | 1228 | 25.2178 |
| 1227 | 21.7032 | | 1227 | 25.197 |
| 1226 | 21.7139 | | 1226 | 25.1829 |
| 1225 | 21.7337 | | 1225 | 25.1873 |
| 1224 | 21.7094 | | 1224 | 25.1797 |
| 1223 | 21.706 | | 1223 | 25.1857 |
| 1222 | 21.6985 | | 1222 | 25.1754 |
| 1221 | 21.6747 | | 1221 | 25.1618 |
| 1220 | 21.6942 | | 1220 | 25.1727 |
| 1219 | 21.6656 | | 1219 | 25.1389 |
| 1218 | 21.6574 | | 1218 | 25.1432 |
| 1217 | 21.6814 | | 1217 | 25.154 |
| 1216 | 21.6865 | | 1216 | 25.1438 |
| 1215 | 21.7084 | | 1215 | 25.1915 |
| 1214 | 21.7026 | | 1214 | 25.179 |

FIG. 51

| Tape in black | | | Tape in white | |
|---|---|---|---|---|
| Wavelength (μm) | Light transmittance T (%) | | Wavelength (μm) | Light transmittance T (%) |
| 1213 | 21.6916 | | 1213 | 25.1608 |
| 1212 | 21.682 | | 1212 | 25.173 |
| 1211 | 21.6629 | | 1211 | 25.1373 |
| 1210 | 21.6561 | | 1210 | 25.1438 |
| 1209 | 21.6697 | | 1209 | 25.154 |
| 1208 | 21.6817 | | 1208 | 25.1583 |
| 1207 | 21.6909 | | 1207 | 25.1569 |
| 1206 | 21.7006 | | 1206 | 25.1638 |
| 1205 | 21.6762 | | 1205 | 25.1666 |
| 1204 | 21.6455 | | 1204 | 25.1426 |
| 1203 | 21.6435 | | 1203 | 25.1381 |
| 1202 | 21.6238 | | 1202 | 25.1163 |
| 1201 | 21.6216 | | 1201 | 25.089 |
| 1200 | 21.6087 | | 1200 | 25.1216 |
| 1199 | 21.5938 | | 1199 | 25.1169 |
| 1198 | 21.5977 | | 1198 | 25.1288 |
| 1197 | 21.6052 | | 1197 | 25.1373 |
| 1196 | 21.6131 | | 1196 | 25.1312 |
| 1195 | 21.6098 | | 1195 | 25.1255 |
| 1194 | 21.627 | | 1194 | 25.1425 |
| 1193 | 21.629 | | 1193 | 25.1141 |
| 1192 | 21.6394 | | 1192 | 25.1178 |
| 1191 | 21.6438 | | 1191 | 25.1302 |
| 1190 | 21.6387 | | 1190 | 25.1144 |
| 1189 | 21.6292 | | 1189 | 25.1314 |
| 1188 | 21.6234 | | 1188 | 25.1297 |
| 1187 | 21.6403 | | 1187 | 25.1318 |
| 1186 | 21.6337 | | 1186 | 25.1291 |

FIG. 52

| Tape in black | | | Tape in white | |
|---|---|---|---|---|
| Wavelength (μm) | Light transmittance T (%) | | Wavelength (μm) | Light transmittance T (%) |
| 1185 | 21.6285 | | 1185 | 25.1137 |
| 1184 | 21.6093 | | 1184 | 25.0976 |
| 1183 | 21.595 | | 1183 | 25.0905 |
| 1182 | 21.5918 | | 1182 | 25.0922 |
| 1181 | 21.6065 | | 1181 | 25.1132 |
| 1180 | 21.6299 | | 1180 | 25.1325 |
| 1179 | 21.6563 | | 1179 | 25.128 |
| 1178 | 21.6701 | | 1178 | 25.1272 |
| 1177 | 21.665 | | 1177 | 25.1203 |
| 1176 | 21.6362 | | 1176 | 25.1055 |
| 1175 | 21.613 | | 1175 | 25.1119 |
| 1174 | 21.61 | | 1174 | 25.1181 |
| 1173 | 21.6429 | | 1173 | 25.1362 |
| 1172 | 21.6733 | | 1172 | 25.1538 |
| 1171 | 21.672 | | 1171 | 25.1439 |
| 1170 | 21.6867 | | 1170 | 25.15 |
| 1169 | 21.638 | | 1169 | 25.1177 |
| 1168 | 21.6377 | | 1168 | 25.1158 |
| 1167 | 21.6412 | | 1167 | 25.1223 |
| 1166 | 21.6335 | | 1166 | 25.1227 |
| 1165 | 21.6519 | | 1165 | 25.1231 |
| 1164 | 21.6377 | | 1164 | 25.1084 |
| 1163 | 21.6445 | | 1163 | 25.1142 |
| 1162 | 21.6236 | | 1162 | 25.1064 |
| 1161 | 21.6068 | | 1161 | 25.0972 |
| 1160 | 21.617 | | 1160 | 25.0945 |
| 1159 | 21.6098 | | 1159 | 25.1023 |
| 1158 | 21.6067 | | 1158 | 25.0942 |

FIG. 53

| Tape in black | | | Tape in white | |
|---|---|---|---|---|
| Wavelength (μm) | Light transmittance T (%) | | Wavelength (μm) | Light transmittance T (%) |
| 1157 | 21.6263 | | 1157 | 25.1059 |
| 1156 | 21.63 | | 1156 | 25.1283 |
| 1155 | 21.6358 | | 1155 | 25.1174 |
| 1154 | 21.6446 | | 1154 | 25.1194 |
| 1153 | 21.63 | | 1153 | 25.1137 |
| 1152 | 21.6274 | | 1152 | 25.1053 |
| 1151 | 21.6151 | | 1151 | 25.1166 |
| 1150 | 21.6021 | | 1150 | 25.114 |
| 1149 | 21.6082 | | 1149 | 25.1121 |
| 1148 | 21.6035 | | 1148 | 25.1124 |
| 1147 | 21.6072 | | 1147 | 25.1101 |
| 1146 | 21.6103 | | 1146 | 25.0942 |
| 1145 | 21.6164 | | 1145 | 25.1016 |
| 1144 | 21.615 | | 1144 | 25.0942 |
| 1143 | 21.601 | | 1143 | 25.0813 |
| 1142 | 21.6192 | | 1142 | 25.1046 |
| 1141 | 21.6081 | | 1141 | 25.0928 |
| 1140 | 21.621 | | 1140 | 25.1039 |
| 1139 | 21.6374 | | 1139 | 25.1015 |
| 1138 | 21.632 | | 1138 | 25.0915 |
| 1137 | 21.6438 | | 1137 | 25.1066 |
| 1136 | 21.6226 | | 1136 | 25.081 |
| 1135 | 21.6033 | | 1135 | 25.0718 |
| 1134 | 21.6038 | | 1134 | 25.083 |
| 1133 | 21.5987 | | 1133 | 25.0958 |
| 1132 | 21.6108 | | 1132 | 25.1032 |
| 1131 | 21.6195 | | 1131 | 25.0956 |
| 1130 | 21.6227 | | 1130 | 25.0945 |

FIG. 54

| Tape in black | | | Tape in white | |
|---|---|---|---|---|
| Wavelength (μm) | Light transmittance T (%) | | Wavelength (μm) | Light transmittance T (%) |
| 1129 | 21.6118 | | 1129 | 25.0622 |
| 1128 | 21.6048 | | 1128 | 25.0747 |
| 1127 | 21.6231 | | 1127 | 25.0883 |
| 1126 | 21.6329 | | 1126 | 25.0884 |
| 1125 | 21.6452 | | 1125 | 25.1005 |
| 1124 | 21.644 | | 1124 | 25.0851 |
| 1123 | 21.6268 | | 1123 | 25.0826 |
| 1122 | 21.6137 | | 1122 | 25.0758 |
| 1121 | 21.6266 | | 1121 | 25.0828 |
| 1120 | 21.6389 | | 1120 | 25.0947 |
| 1119 | 21.638 | | 1119 | 25.1038 |
| 1118 | 21.6437 | | 1118 | 25.1136 |
| 1117 | 21.6502 | | 1117 | 25.1247 |
| 1116 | 21.6412 | | 1116 | 25.1268 |
| 1115 | 21.6491 | | 1115 | 25.1367 |
| 1114 | 21.6505 | | 1114 | 25.1296 |
| 1113 | 21.6404 | | 1113 | 25.1208 |
| 1112 | 21.6326 | | 1112 | 25.0968 |
| 1111 | 21.6279 | | 1111 | 25.0834 |
| 1110 | 21.6209 | | 1110 | 25.0811 |
| 1109 | 21.6071 | | 1109 | 25.0535 |
| 1108 | 21.6211 | | 1108 | 25.0768 |
| 1107 | 21.6352 | | 1107 | 25.0839 |
| 1106 | 21.6399 | | 1106 | 25.0822 |
| 1105 | 21.66 | | 1105 | 25.1128 |
| 1104 | 21.6501 | | 1104 | 25.109 |
| 1103 | 21.6272 | | 1103 | 25.092 |
| 1102 | 21.618 | | 1102 | 25.0934 |

FIG. 55

| Tape in black | | | Tape in white | |
|---|---|---|---|---|
| Wavelength (μm) | Light transmittance T (%) | | Wavelength (μm) | Light transmittance T (%) |
| 1101 | 21.5967 | | 1101 | 25.089 |
| 1100 | 21.6103 | | 1100 | 25.0891 |
| 1099 | 21.6338 | | 1099 | 25.1005 |
| 1098 | 21.628 | | 1098 | 25.0901 |
| 1097 | 21.6222 | | 1097 | 25.0675 |
| 1096 | 21.6129 | | 1096 | 25.0525 |
| 1095 | 21.5903 | | 1095 | 25.0376 |
| 1094 | 21.5842 | | 1094 | 25.0274 |
| 1093 | 21.5766 | | 1093 | 25.0258 |
| 1092 | 21.5804 | | 1092 | 25.0359 |
| 1091 | 21.5943 | | 1091 | 25.0435 |
| 1090 | 21.6172 | | 1090 | 25.0599 |
| 1089 | 21.6337 | | 1089 | 25.0793 |
| 1088 | 21.6424 | | 1088 | 25.0822 |
| 1087 | 21.6363 | | 1087 | 25.0858 |
| 1086 | 21.6419 | | 1086 | 25.0852 |
| 1085 | 21.6347 | | 1085 | 25.0779 |
| 1084 | 21.621 | | 1084 | 25.0735 |
| 1083 | 21.6097 | | 1083 | 25.0604 |
| 1082 | 21.6075 | | 1082 | 25.0609 |
| 1081 | 21.6124 | | 1081 | 25.0713 |
| 1080 | 21.6092 | | 1080 | 25.0762 |
| 1079 | 21.633 | | 1079 | 25.085 |
| 1078 | 21.6296 | | 1078 | 25.0753 |
| 1077 | 21.6284 | | 1077 | 25.069 |
| 1076 | 21.6164 | | 1076 | 25.048 |
| 1075 | 21.5873 | | 1075 | 25.0447 |
| 1074 | 21.5711 | | 1074 | 25.0462 |

FIG. 56

| Tape in black | | | Tape in white | |
|---|---|---|---|---|
| Wavelength (μm) | Light transmittance T (%) | | Wavelength (μm) | Light transmittance T (%) |
| 1073 | 21.5786 | | 1073 | 25.0449 |
| 1072 | 21.5785 | | 1072 | 25.0508 |
| 1071 | 21.6013 | | 1071 | 25.0541 |
| 1070 | 21.5906 | | 1070 | 25.0465 |
| 1069 | 21.5785 | | 1069 | 25.0455 |
| 1068 | 21.5927 | | 1068 | 25.0463 |
| 1067 | 21.5798 | | 1067 | 25.0278 |
| 1066 | 21.5966 | | 1066 | 25.0289 |
| 1065 | 21.6195 | | 1065 | 25.0419 |
| 1064 | 21.608 | | 1064 | 25.0387 |
| 1063 | 21.6074 | | 1063 | 25.0553 |
| 1062 | 21.6099 | | 1062 | 25.068 |
| 1061 | 21.5858 | | 1061 | 25.0516 |
| 1060 | 21.6045 | | 1060 | 25.0646 |
| 1059 | 21.6155 | | 1059 | 25.0569 |
| 1058 | 21.6223 | | 1058 | 25.0611 |
| 1057 | 21.6271 | | 1057 | 25.0467 |
| 1056 | 21.6316 | | 1056 | 25.0507 |
| 1055 | 21.6328 | | 1055 | 25.074 |
| 1054 | 21.6288 | | 1054 | 25.0587 |
| 1053 | 21.6382 | | 1053 | 25.0723 |
| 1052 | 21.6205 | | 1052 | 25.0739 |
| 1051 | 21.6108 | | 1051 | 25.0598 |
| 1050 | 21.612 | | 1050 | 25.0618 |
| 1049 | 21.614 | | 1049 | 25.0577 |
| 1048 | 21.6167 | | 1048 | 25.0474 |
| 1047 | 21.6096 | | 1047 | 25.0396 |
| 1046 | 21.592 | | 1046 | 25.0458 |

FIG. 57

| Tape in black | | | Tape in white | |
|---|---|---|---|---|
| Wavelength (μm) | Light transmittance T (%) | | Wavelength (μm) | Light transmittance T (%) |
| 1045 | 21.5755 | | 1045 | 25.0403 |
| 1044 | 21.5637 | | 1044 | 25.0447 |
| 1043 | 21.577 | | 1043 | 25.0413 |
| 1042 | 21.587 | | 1042 | 25.0207 |
| 1041 | 21.583 | | 1041 | 25.0082 |
| 1040 | 21.6093 | | 1040 | 25.0012 |
| 1039 | 21.5941 | | 1039 | 25.003 |
| 1038 | 21.5864 | | 1038 | 25.0045 |
| 1037 | 21.5871 | | 1037 | 25.0281 |
| 1036 | 21.5713 | | 1036 | 25.0253 |
| 1035 | 21.5794 | | 1035 | 25.008 |
| 1034 | 21.5653 | | 1034 | 25.0093 |
| 1033 | 21.5632 | | 1033 | 24.98 |
| 1032 | 21.562 | | 1032 | 24.9869 |
| 1031 | 21.5638 | | 1031 | 24.9937 |
| 1030 | 21.5743 | | 1030 | 25.0174 |
| 1029 | 21.5892 | | 1029 | 25.0482 |
| 1028 | 21.5731 | | 1028 | 25.0299 |
| 1027 | 21.5663 | | 1027 | 25.031 |
| 1026 | 21.5617 | | 1026 | 25.0193 |
| 1025 | 21.5404 | | 1025 | 24.9949 |
| 1024 | 21.5507 | | 1024 | 24.9994 |
| 1023 | 21.5583 | | 1023 | 25.002 |
| 1022 | 21.5666 | | 1022 | 24.9992 |
| 1021 | 21.5565 | | 1021 | 25.001 |
| 1020 | 21.5428 | | 1020 | 25.0052 |
| 1019 | 21.5284 | | 1019 | 24.9936 |
| 1018 | 21.5311 | | 1018 | 24.9808 |

FIG. 58

| Tape in black | | | Tape in white | |
|---|---|---|---|---|
| Wavelength (μm) | Light transmittance T (%) | | Wavelength (μm) | Light transmittance T (%) |
| 1017 | 21.5614 | | 1017 | 24.9953 |
| 1016 | 21.5644 | | 1016 | 24.9885 |
| 1015 | 21.5671 | | 1015 | 25.0069 |
| 1014 | 21.5613 | | 1014 | 25.0085 |
| 1013 | 21.5487 | | 1013 | 24.999 |
| 1012 | 21.5536 | | 1012 | 24.9885 |
| 1011 | 21.5683 | | 1011 | 24.9909 |
| 1010 | 21.5822 | | 1010 | 24.9939 |
| 1009 | 21.585 | | 1009 | 24.9986 |
| 1008 | 21.5765 | | 1008 | 25.0079 |
| 1007 | 21.55 | | 1007 | 24.9923 |
| 1006 | 21.5281 | | 1006 | 24.9875 |
| 1005 | 21.5077 | | 1005 | 24.97 |
| 1004 | 21.5237 | | 1004 | 24.9684 |
| 1003 | 21.5181 | | 1003 | 24.9555 |
| 1002 | 21.5243 | | 1002 | 24.9622 |
| 1001 | 21.5353 | | 1001 | 24.9665 |
| 1000 | 21.5266 | | 1000 | 24.9653 |
| 999 | 21.5488 | | 999 | 24.9612 |
| 998 | 21.5529 | | 998 | 24.9482 |
| 997 | 21.5474 | | 997 | 24.9581 |
| 996 | 21.5294 | | 996 | 24.9551 |
| 995 | 21.5276 | | 995 | 24.9707 |
| 994 | 21.5356 | | 994 | 24.9688 |
| 993 | 21.5236 | | 993 | 24.9509 |
| 992 | 21.5344 | | 992 | 24.9452 |
| 991 | 21.5303 | | 991 | 24.9334 |
| 990 | 21.5202 | | 990 | 24.9572 |

FIG. 59

| Tape in black | | | Tape in white | |
|---|---|---|---|---|
| Wavelength (μm) | Light transmittance T (%) | | Wavelength (μm) | Light transmittance T (%) |
| 989 | 21.5344 | | 989 | 24.9521 |
| 988 | 21.5388 | | 988 | 24.9493 |
| 987 | 21.5394 | | 987 | 24.9508 |
| 986 | 21.5275 | | 986 | 24.924 |
| 985 | 21.5068 | | 985 | 24.9368 |
| 984 | 21.498 | | 984 | 24.9274 |
| 983 | 21.5027 | | 983 | 24.9388 |
| 982 | 21.496 | | 982 | 24.9271 |
| 981 | 21.5178 | | 981 | 24.9264 |
| 980 | 21.5413 | | 980 | 24.9476 |
| 979 | 21.5301 | | 979 | 24.9402 |
| 978 | 21.551 | | 978 | 24.9656 |
| 977 | 21.5514 | | 977 | 24.9679 |
| 976 | 21.5343 | | 976 | 24.9453 |
| 975 | 21.526 | | 975 | 24.9419 |
| 974 | 21.5229 | | 974 | 24.94 |
| 973 | 21.5044 | | 973 | 24.9055 |
| 972 | 21.4949 | | 972 | 24.9017 |
| 971 | 21.4831 | | 971 | 24.8828 |
| 970 | 21.4521 | | 970 | 24.8667 |
| 969 | 21.4412 | | 969 | 24.8735 |
| 968 | 21.4528 | | 968 | 24.8843 |
| 967 | 21.4446 | | 967 | 24.8881 |
| 966 | 21.4533 | | 966 | 24.8778 |
| 965 | 21.4588 | | 965 | 24.8861 |
| 964 | 21.4525 | | 964 | 24.8666 |
| 963 | 21.4741 | | 963 | 24.8761 |
| 962 | 21.4767 | | 962 | 24.8812 |

FIG. 60

| Tape in black | | | Tape in white | |
|---|---|---|---|---|
| Wavelength (μm) | Light transmittance T (%) | | Wavelength (μm) | Light transmittance T (%) |
| 961 | 21.4813 | | 961 | 24.873 |
| 960 | 21.4726 | | 960 | 24.8778 |
| 959 | 21.4717 | | 959 | 24.8864 |
| 958 | 21.4574 | | 958 | 24.8771 |
| 957 | 21.4724 | | 957 | 24.8739 |
| 956 | 21.467 | | 956 | 24.8623 |
| 955 | 21.4574 | | 955 | 24.8417 |
| 954 | 21.4489 | | 954 | 24.8371 |
| 953 | 21.4455 | | 953 | 24.8591 |
| 952 | 21.4322 | | 952 | 24.8868 |
| 951 | 21.4492 | | 951 | 24.8991 |
| 950 | 21.474 | | 950 | 24.9138 |
| 949 | 21.504 | | 949 | 24.9188 |
| 948 | 21.5404 | | 948 | 24.9372 |
| 947 | 21.5529 | | 947 | 24.9465 |
| 946 | 21.5737 | | 946 | 24.9462 |
| 945 | 21.5488 | | 945 | 24.9399 |
| 944 | 21.5454 | | 944 | 24.9225 |
| 943 | 21.4998 | | 943 | 24.9237 |
| 942 | 21.4772 | | 942 | 24.9149 |
| 941 | 21.4823 | | 941 | 24.9358 |
| 940 | 21.4798 | | 940 | 24.9257 |
| 939 | 21.4885 | | 939 | 24.9136 |
| 938 | 21.5172 | | 938 | 24.9528 |
| 937 | 21.5143 | | 937 | 24.9391 |
| 936 | 21.5011 | | 936 | 24.9352 |
| 935 | 21.5097 | | 935 | 24.9708 |
| 934 | 21.4854 | | 934 | 24.942 |

FIG. 61

| Tape in black | | | Tape in white | |
|---|---|---|---|---|
| Wavelength (μm) | Light transmittance T (%) | | Wavelength (μm) | Light transmittance T (%) |
| 933 | 21.468 | | 933 | 24.923 |
| 932 | 21.4751 | | 932 | 24.9304 |
| 931 | 21.5074 | | 931 | 24.9093 |
| 930 | 21.4938 | | 930 | 24.9038 |
| 929 | 21.4917 | | 929 | 24.9161 |
| 928 | 21.4737 | | 928 | 24.9054 |
| 927 | 21.4472 | | 927 | 24.8893 |
| 926 | 21.459 | | 926 | 24.8867 |
| 925 | 21.4385 | | 925 | 24.842 |
| 924 | 21.4562 | | 924 | 24.8499 |
| 923 | 21.4454 | | 923 | 24.8403 |
| 922 | 21.4264 | | 922 | 24.8356 |
| 921 | 21.4411 | | 921 | 24.8763 |
| 920 | 21.4423 | | 920 | 24.8923 |
| 919 | 21.4696 | | 919 | 24.8791 |
| 918 | 21.4901 | | 918 | 24.9016 |
| 917 | 21.5114 | | 917 | 24.893 |
| 916 | 21.5094 | | 916 | 24.8747 |
| 915 | 21.4669 | | 915 | 24.8915 |
| 914 | 21.4267 | | 914 | 24.8667 |
| 913 | 21.4332 | | 913 | 24.8551 |
| 912 | 21.4222 | | 912 | 24.831 |
| 911 | 21.4316 | | 911 | 24.8023 |
| 910 | 21.4713 | | 910 | 24.8174 |
| 909 | 21.4367 | | 909 | 24.8461 |
| 908 | 21.4457 | | 908 | 24.8569 |
| 907 | 21.4608 | | 907 | 24.8578 |
| 906 | 21.4242 | | 906 | 24.8665 |

FIG. 62

| Tape in black | | | Tape in white | |
|---|---|---|---|---|
| Wavelength (μm) | Light transmittance T (%) | | Wavelength (μm) | Light transmittance T (%) |
| 905 | 21.4397 | | 905 | 24.8166 |
| 904 | 21.4452 | | 904 | 24.8143 |
| 903 | 21.4255 | | 903 | 24.8228 |
| 902 | 21.4558 | | 902 | 24.7668 |
| 901 | 21.4342 | | 901 | 24.7997 |
| 900 | 21.4353 | | 900 | 24.8035 |
| 899 | 21.4446 | | 899 | 24.8013 |
| 898 | 21.4657 | | 898 | 24.8037 |
| 897 | 21.4372 | | 897 | 24.7695 |
| 896 | 21.3983 | | 896 | 24.7455 |
| 895 | 21.4273 | | 895 | 24.7804 |
| 894 | 21.3995 | | 894 | 24.796 |
| 893 | 21.4492 | | 893 | 24.8016 |
| 892 | 21.4703 | | 892 | 24.8182 |
| 891 | 21.4496 | | 891 | 24.792 |
| 890 | 21.4145 | | 890 | 24.7998 |
| 889 | 21.3915 | | 889 | 24.8307 |
| 888 | 21.401 | | 888 | 24.8401 |
| 887 | 21.3627 | | 887 | 24.8382 |
| 886 | 21.3607 | | 886 | 24.8113 |
| 885 | 21.3801 | | 885 | 24.7936 |
| 884 | 21.3341 | | 884 | 24.7487 |
| 883 | 21.3689 | | 883 | 24.7234 |
| 882 | 21.4067 | | 882 | 24.7433 |
| 881 | 21.3838 | | 881 | 24.7465 |
| 880 | 21.4505 | | 880 | 24.7738 |
| 879 | 21.4538 | | 879 | 24.798 |
| 878 | 21.443 | | 878 | 24.8269 |

FIG. 63

| Tape in black | | | Tape in white | |
|---|---|---|---|---|
| Wavelength (μm) | Light transmittance T (%) | | Wavelength (μm) | Light transmittance T (%) |
| 877 | 21.4947 | | 877 | 24.7763 |
| 876 | 21.3778 | | 876 | 24.7541 |
| 875 | 21.3631 | | 875 | 24.7277 |
| 874 | 21.376 | | 874 | 24.7182 |
| 873 | 21.3965 | | 873 | 24.8024 |
| 872 | 21.5281 | | 872 | 24.8899 |
| 871 | 21.5382 | | 871 | 24.9218 |
| 870 | 21.5277 | | 870 | 24.8819 |
| 869 | 21.4457 | | 869 | 24.8705 |
| 868 | 21.4251 | | 868 | 24.8191 |
| 867 | 21.4229 | | 867 | 24.8147 |
| 866 | 21.3965 | | 866 | 24.842 |
| 865 | 21.4025 | | 865 | 24.8191 |
| 864 | 21.3544 | | 864 | 24.8468 |
| 863 | 21.3196 | | 863 | 24.8904 |
| 862 | 21.3217 | | 862 | 24.8734 |
| 861 | 21.3167 | | 861 | 24.8452 |
| 860 | 21.7633 | | 860 | 24.836 |
| 859 | 21.6386 | | 859 | 25.0196 |
| 858 | 21.8014 | | 858 | 25.0867 |
| 857 | 21.758 | | 857 | 25.0826 |
| 856 | 21.8537 | | 856 | 25.1822 |
| 855 | 21.958 | | 855 | 25.0755 |
| 854 | 21.7795 | | 854 | 24.98 |
| 853 | 21.8385 | | 853 | 24.9235 |
| 852 | 21.8652 | | 852 | 24.8336 |
| 851 | 21.679 | | 851 | 24.745 |
| 850 | 21.6637 | | 850 | 24.5902 |

FIG. 64

| Tape in black | | | Tape in white | |
|---|---|---|---|---|
| Wavelength (μm) | Light transmittance T (%) | | Wavelength (μm) | Light transmittance T (%) |
| 849 | 21.693 | | 849 | 24.7719 |
| 848 | 21.6952 | | 848 | 24.8626 |
| 847 | 21.7963 | | 847 | 24.9778 |
| 846 | 21.8801 | | 846 | 25.1357 |
| 845 | 21.8646 | | 845 | 25.0127 |
| 844 | 21.7934 | | 844 | 25.0418 |
| 843 | 21.6918 | | 843 | 24.9604 |
| 842 | 21.7108 | | 842 | 24.9613 |
| 841 | 21.6744 | | 841 | 25.0892 |
| 840 | 21.6936 | | 840 | 25.0393 |
| 839 | 21.7358 | | 839 | 25.0136 |
| 838 | 21.6368 | | 838 | 24.978 |
| 837 | 21.6987 | | 837 | 24.9738 |
| 836 | 21.7044 | | 836 | 24.9589 |
| 835 | 21.6588 | | 835 | 25.0132 |
| 834 | 21.6984 | | 834 | 25.0294 |
| 833 | 21.6341 | | 833 | 24.9768 |
| 832 | 21.6308 | | 832 | 24.993 |
| 831 | 21.6584 | | 831 | 24.9696 |
| 830 | 21.5967 | | 830 | 24.9567 |
| 829 | 21.5364 | | 829 | 24.9208 |
| 828 | 21.5311 | | 828 | 24.9074 |
| 827 | 21.4683 | | 827 | 24.9342 |
| 826 | 21.5379 | | 826 | 24.9536 |
| 825 | 21.5708 | | 825 | 25.0148 |
| 824 | 21.5142 | | 824 | 25.0315 |
| 823 | 21.4925 | | 823 | 25.0147 |
| 822 | 21.4677 | | 822 | 25.0456 |

FIG. 65

| Tape in black | | | Tape in white | |
|---|---|---|---|---|
| Wavelength (μm) | Light transmittance T (%) | | Wavelength (μm) | Light transmittance T (%) |
| 821 | 21.4652 | | 821 | 25.0278 |
| 820 | 21.5186 | | 820 | 25.0013 |
| 819 | 21.537 | | 819 | 24.9879 |
| 818 | 21.5177 | | 818 | 24.9388 |
| 817 | 21.5577 | | 817 | 24.9254 |
| 816 | 21.5471 | | 816 | 24.9341 |
| 815 | 21.5615 | | 815 | 24.9565 |
| 814 | 21.5683 | | 814 | 24.8965 |
| 813 | 21.5633 | | 813 | 24.8981 |
| 812 | 21.5354 | | 812 | 24.8769 |
| 811 | 21.5425 | | 811 | 24.8373 |
| 810 | 21.5548 | | 810 | 24.87 |
| 809 | 21.5101 | | 809 | 24.8381 |
| 808 | 21.5605 | | 808 | 24.8624 |
| 807 | 21.5736 | | 807 | 24.855 |
| 806 | 21.5517 | | 806 | 24.8515 |
| 805 | 21.5789 | | 805 | 24.8551 |
| 804 | 21.5532 | | 804 | 24.8153 |
| 803 | 21.5637 | | 803 | 24.8474 |
| 802 | 21.5738 | | 802 | 24.864 |
| 801 | 21.5593 | | 801 | 24.8754 |
| 800 | 21.5647 | | 800 | 24.8998 |
| 799 | 21.5183 | | 799 | 24.8947 |
| 798 | 21.5136 | | 798 | 24.9065 |
| 797 | 21.5369 | | 797 | 24.924 |
| 796 | 21.5233 | | 796 | 24.9067 |
| 795 | 21.5769 | | 795 | 24.9054 |
| 794 | 21.5968 | | 794 | 24.9088 |

FIG. 66

| Tape in black | | | Tape in white | |
|---|---|---|---|---|
| Wavelength (μm) | Light transmittance T (%) | | Wavelength (μm) | Light transmittance T (%) |
| 793 | 21.581 | | 793 | 24.8777 |
| 792 | 21.6154 | | 792 | 24.8939 |
| 791 | 21.5646 | | 791 | 24.8754 |
| 790 | 21.5637 | | 790 | 24.833 |
| 789 | 21.5652 | | 789 | 24.8563 |
| 788 | 21.5331 | | 788 | 24.8348 |
| 787 | 21.549 | | 787 | 24.8208 |
| 786 | 21.555 | | 786 | 24.8479 |
| 785 | 21.5417 | | 785 | 24.832 |
| 784 | 21.5333 | | 784 | 24.8231 |
| 783 | 21.536 | | 783 | 24.8508 |
| 782 | 21.4895 | | 782 | 24.8179 |
| 781 | 21.4752 | | 781 | 24.7747 |
| 780 | 21.5254 | | 780 | 24.7975 |
| 779 | 21.4953 | | 779 | 24.7902 |
| 778 | 21.4713 | | 778 | 24.8003 |
| 777 | 21.5088 | | 777 | 24.8353 |
| 776 | 21.4574 | | 776 | 24.8491 |
| 775 | 21.4845 | | 775 | 24.8123 |
| 774 | 21.4867 | | 774 | 24.813 |
| 773 | 21.441 | | 773 | 24.8146 |
| 772 | 21.4717 | | 772 | 24.8258 |
| 771 | 21.4513 | | 771 | 24.8745 |
| 770 | 21.4758 | | 770 | 24.874 |
| 769 | 21.5148 | | 769 | 24.861 |
| 768 | 21.499 | | 768 | 24.8115 |
| 767 | 21.5234 | | 767 | 24.8281 |
| 766 | 21.5225 | | 766 | 24.8725 |

FIG. 67

| Tape in black | | | Tape in white | |
|---|---|---|---|---|
| Wavelength (μm) | Light transmittance T (%) | | Wavelength (μm) | Light transmittance T (%) |
| 765 | 21.4771 | | 765 | 24.8714 |
| 764 | 21.4768 | | 764 | 24.8934 |
| 763 | 21.4518 | | 763 | 24.8607 |
| 762 | 21.4729 | | 762 | 24.8106 |
| 761 | 21.4885 | | 761 | 24.7934 |
| 760 | 21.4741 | | 760 | 24.779 |
| 759 | 21.4903 | | 759 | 24.7575 |
| 758 | 21.461 | | 758 | 24.75 |
| 757 | 21.4456 | | 757 | 24.7377 |
| 756 | 21.4785 | | 756 | 24.7625 |
| 755 | 21.4713 | | 755 | 24.7825 |
| 754 | 21.4805 | | 754 | 24.8228 |
| 753 | 21.4803 | | 753 | 24.8317 |
| 752 | 21.4543 | | 752 | 24.8506 |
| 751 | 21.4366 | | 751 | 24.8358 |
| 750 | 21.4125 | | 750 | 24.79 |
| 749 | 21.4172 | | 749 | 24.7813 |
| 748 | 21.421 | | 748 | 24.7192 |
| 747 | 21.4345 | | 747 | 24.7382 |
| 746 | 21.4504 | | 746 | 24.7601 |
| 745 | 21.4502 | | 745 | 24.7896 |
| 744 | 21.4296 | | 744 | 24.7942 |
| 743 | 21.4249 | | 743 | 24.7834 |
| 742 | 21.4203 | | 742 | 24.7693 |
| 741 | 21.442 | | 741 | 24.7867 |
| 740 | 21.45 | | 740 | 24.8082 |
| 739 | 21.4525 | | 739 | 24.8044 |
| 738 | 21.4575 | | 738 | 24.806 |

FIG. 68

| Tape in black | | | Tape in white | |
|---|---|---|---|---|
| Wavelength (μm) | Light transmittance T (%) | | Wavelength (μm) | Light transmittance T (%) |
| 737 | 21.4489 | | 737 | 24.8025 |
| 736 | 21.4297 | | 736 | 24.8034 |
| 735 | 21.3993 | | 735 | 24.8166 |
| 734 | 21.3692 | | 734 | 24.8202 |
| 733 | 21.3714 | | 733 | 24.8015 |
| 732 | 21.3657 | | 732 | 24.7858 |
| 731 | 21.3837 | | 731 | 24.7725 |
| 730 | 21.394 | | 730 | 24.7717 |
| 729 | 21.3745 | | 729 | 24.7797 |
| 728 | 21.3872 | | 728 | 24.7792 |
| 727 | 21.3692 | | 727 | 24.7841 |
| 726 | 21.3438 | | 726 | 24.7838 |
| 725 | 21.3611 | | 725 | 24.8149 |
| 724 | 21.3414 | | 724 | 24.8274 |
| 723 | 21.3388 | | 723 | 24.8118 |
| 722 | 21.3465 | | 722 | 24.81 |
| 721 | 21.3434 | | 721 | 24.7825 |
| 720 | 21.3376 | | 720 | 24.7784 |
| 719 | 21.3339 | | 719 | 24.789 |
| 718 | 21.3231 | | 718 | 24.7648 |
| 717 | 21.2891 | | 717 | 24.7477 |
| 716 | 21.279 | | 716 | 24.7344 |
| 715 | 21.2775 | | 715 | 24.7253 |
| 714 | 21.2548 | | 714 | 24.7181 |
| 713 | 21.2605 | | 713 | 24.7112 |
| 712 | 21.2529 | | 712 | 24.7066 |
| 711 | 21.2536 | | 711 | 24.7067 |
| 710 | 21.2481 | | 710 | 24.718 |

FIG. 69

| Tape in black | | | Tape in white | |
|---|---|---|---|---|
| Wavelength (μm) | Light transmittance T (%) | | Wavelength (μm) | Light transmittance T (%) |
| 709 | 21.2198 | | 709 | 24.72 |
| 708 | 21.2194 | | 708 | 24.7278 |
| 707 | 21.1865 | | 707 | 24.7243 |
| 706 | 21.1876 | | 706 | 24.7357 |
| 705 | 21.2013 | | 705 | 24.7492 |
| 704 | 21.1818 | | 704 | 24.7503 |
| 703 | 21.1792 | | 703 | 24.7627 |
| 702 | 21.1642 | | 702 | 24.7671 |
| 701 | 21.1494 | | 701 | 24.7694 |
| 700 | 21.1342 | | 700 | 24.7717 |
| 699 | 21.1225 | | 699 | 24.7643 |
| 698 | 21.1086 | | 698 | 24.7623 |
| 697 | 21.0837 | | 697 | 24.7646 |
| 696 | 21.0717 | | 696 | 24.7547 |
| 695 | 21.0457 | | 695 | 24.7339 |
| 694 | 21.016 | | 694 | 24.7139 |
| 693 | 20.9966 | | 693 | 24.6915 |
| 692 | 20.9752 | | 692 | 24.6987 |
| 691 | 20.94 | | 691 | 24.6871 |
| 690 | 20.915 | | 690 | 24.6699 |
| 689 | 20.8837 | | 689 | 24.661 |
| 688 | 20.8437 | | 688 | 24.6243 |
| 687 | 20.8222 | | 687 | 24.6276 |
| 686 | 20.793 | | 686 | 24.6042 |
| 685 | 20.7591 | | 685 | 24.5667 |
| 684 | 20.7286 | | 684 | 24.5564 |
| 683 | 20.6989 | | 683 | 24.5383 |
| 682 | 20.6696 | | 682 | 24.5572 |

FIG. 70

| Tape in black | | | Tape in white | |
|---|---|---|---|---|
| Wavelength (μm) | Light transmittance T (%) | | Wavelength (μm) | Light transmittance T (%) |
| 681 | 20.6588 | | 681 | 24.5852 |
| 680 | 20.6341 | | 680 | 24.5838 |
| 679 | 20.6234 | | 679 | 24.5739 |
| 678 | 20.6385 | | 678 | 24.5831 |
| 677 | 20.6513 | | 677 | 24.605 |
| 676 | 20.6697 | | 676 | 24.6485 |
| 675 | 20.6734 | | 675 | 24.6815 |
| 674 | 20.6486 | | 674 | 24.6948 |
| 673 | 20.6107 | | 673 | 24.6888 |
| 672 | 20.5911 | | 672 | 24.6787 |
| 671 | 20.576 | | 671 | 24.6793 |
| 670 | 20.5519 | | 670 | 24.6606 |
| 669 | 20.525 | | 669 | 24.6348 |
| 668 | 20.4925 | | 668 | 24.6155 |
| 667 | 20.4808 | | 667 | 24.6158 |
| 666 | 20.4831 | | 666 | 24.6185 |
| 665 | 20.4851 | | 665 | 24.6491 |
| 664 | 20.4819 | | 664 | 24.6626 |
| 663 | 20.4553 | | 663 | 24.6651 |
| 662 | 20.4474 | | 662 | 24.6552 |
| 661 | 20.4445 | | 661 | 24.6449 |
| 660 | 20.437 | | 660 | 24.6419 |
| 659 | 20.4152 | | 659 | 24.6259 |
| 658 | 20.3931 | | 658 | 24.627 |
| 657 | 20.3656 | | 657 | 24.6127 |
| 656 | 20.3722 | | 656 | 24.6321 |
| 655 | 20.384 | | 655 | 24.6386 |
| 654 | 20.3734 | | 654 | 24.6475 |

FIG. 71

| Tape in black | | | Tape in white | |
|---|---|---|---|---|
| Wavelength (μm) | Light transmittance T (%) | | Wavelength (μm) | Light transmittance T (%) |
| 653 | 20.3862 | | 653 | 24.6725 |
| 652 | 20.3457 | | 652 | 24.6476 |
| 651 | 20.3306 | | 651 | 24.6404 |
| 650 | 20.3179 | | 650 | 24.648 |
| 649 | 20.2836 | | 649 | 24.627 |
| 648 | 20.2686 | | 648 | 24.5876 |
| 647 | 20.2599 | | 647 | 24.5942 |
| 646 | 20.2608 | | 646 | 24.5802 |
| 645 | 20.273 | | 645 | 24.5976 |
| 644 | 20.2727 | | 644 | 24.6139 |
| 643 | 20.2651 | | 643 | 24.6113 |
| 642 | 20.2598 | | 642 | 24.6055 |
| 641 | 20.2476 | | 641 | 24.5658 |
| 640 | 20.247 | | 640 | 24.5688 |
| 639 | 20.2408 | | 639 | 24.5663 |
| 638 | 20.2372 | | 638 | 24.5853 |
| 637 | 20.2352 | | 637 | 24.6043 |
| 636 | 20.2367 | | 636 | 24.6214 |
| 635 | 20.2415 | | 635 | 24.6348 |
| 634 | 20.24 | | 634 | 24.6159 |
| 633 | 20.2222 | | 633 | 24.6188 |
| 632 | 20.2241 | | 632 | 24.6133 |
| 631 | 20.2161 | | 631 | 24.607 |
| 630 | 20.198 | | 630 | 24.6052 |
| 629 | 20.2047 | | 629 | 24.5949 |
| 628 | 20.1965 | | 628 | 24.5915 |
| 627 | 20.1946 | | 627 | 24.5817 |
| 626 | 20.197 | | 626 | 24.5806 |

FIG. 72

| Tape in black | | | Tape in white | |
|---|---|---|---|---|
| Wavelength (μm) | Light transmittance T (%) | | Wavelength (μm) | Light transmittance T (%) |
| 625 | 20.195 | | 625 | 24.5844 |
| 624 | 20.2006 | | 624 | 24.5922 |
| 623 | 20.2031 | | 623 | 24.6114 |
| 622 | 20.2099 | | 622 | 24.6177 |
| 621 | 20.2177 | | 621 | 24.6193 |
| 620 | 20.2124 | | 620 | 24.6201 |
| 619 | 20.2015 | | 619 | 24.592 |
| 618 | 20.1947 | | 618 | 24.5912 |
| 617 | 20.1874 | | 617 | 24.6052 |
| 616 | 20.1673 | | 616 | 24.5988 |
| 615 | 20.1611 | | 615 | 24.6007 |
| 614 | 20.1501 | | 614 | 24.5943 |
| 613 | 20.1369 | | 613 | 24.584 |
| 612 | 20.156 | | 612 | 24.5851 |
| 611 | 20.1558 | | 611 | 24.5903 |
| 610 | 20.165 | | 610 | 24.6053 |
| 609 | 20.1626 | | 609 | 24.6013 |
| 608 | 20.1606 | | 608 | 24.5913 |
| 607 | 20.1631 | | 607 | 24.5784 |
| 606 | 20.1568 | | 606 | 24.5528 |
| 605 | 20.1639 | | 605 | 24.5499 |
| 604 | 20.1517 | | 604 | 24.5267 |
| 603 | 20.1502 | | 603 | 24.5289 |
| 602 | 20.1422 | | 602 | 24.5371 |
| 601 | 20.1232 | | 601 | 24.5256 |
| 600 | 20.1595 | | 600 | 24.569 |
| 599 | 20.1618 | | 599 | 24.5583 |
| 598 | 20.1483 | | 598 | 24.5577 |

FIG. 73

| Tape in black | | | Tape in white | |
|---|---|---|---|---|
| Wavelength (μm) | Light transmittance T (%) | | Wavelength (μm) | Light transmittance T (%) |
| 597 | 20.1493 | | 597 | 24.5644 |
| 596 | 20.1652 | | 596 | 24.561 |
| 595 | 20.161 | | 595 | 24.5611 |
| 594 | 20.1779 | | 594 | 24.5646 |
| 593 | 20.1828 | | 593 | 24.5528 |
| 592 | 20.1788 | | 592 | 24.565 |
| 591 | 20.1904 | | 591 | 24.5714 |
| 590 | 20.1929 | | 590 | 24.5669 |
| 589 | 20.1808 | | 589 | 24.5679 |
| 588 | 20.1703 | | 588 | 24.5621 |
| 587 | 20.1571 | | 587 | 24.5416 |
| 586 | 20.1462 | | 586 | 24.5336 |
| 585 | 20.1412 | | 585 | 24.5247 |
| 584 | 20.1461 | | 584 | 24.5314 |
| 583 | 20.1488 | | 583 | 24.5508 |
| 582 | 20.151 | | 582 | 24.5573 |
| 581 | 20.1533 | | 581 | 24.5483 |
| 580 | 20.1439 | | 580 | 24.5378 |
| 579 | 20.1484 | | 579 | 24.5434 |
| 578 | 20.1437 | | 578 | 24.5464 |
| 577 | 20.1603 | | 577 | 24.5603 |
| 576 | 20.1699 | | 576 | 24.5567 |
| 575 | 20.1781 | | 575 | 24.5468 |
| 574 | 20.2004 | | 574 | 24.5497 |
| 573 | 20.199 | | 573 | 24.5596 |
| 572 | 20.209 | | 572 | 24.5562 |
| 571 | 20.1872 | | 571 | 24.5555 |
| 570 | 20.1861 | | 570 | 24.534 |

FIG. 74

| Tape in black | | | Tape in white | |
|---|---|---|---|---|
| Wavelength (μm) | Light transmittance T (%) | | Wavelength (μm) | Light transmittance T (%) |
| 569 | 20.1814 | | 569 | 24.5307 |
| 568 | 20.1729 | | 568 | 24.5283 |
| 567 | 20.1869 | | 567 | 24.5381 |
| 566 | 20.1836 | | 566 | 24.5329 |
| 565 | 20.19 | | 565 | 24.5209 |
| 564 | 20.1964 | | 564 | 24.5234 |
| 563 | 20.2045 | | 563 | 24.5007 |
| 562 | 20.2008 | | 562 | 24.5156 |
| 561 | 20.1989 | | 561 | 24.5298 |
| 560 | 20.2011 | | 560 | 24.5352 |
| 559 | 20.2008 | | 559 | 24.5447 |
| 558 | 20.2145 | | 558 | 24.5615 |
| 557 | 20.2185 | | 557 | 24.5341 |
| 556 | 20.2258 | | 556 | 24.5199 |
| 555 | 20.2381 | | 555 | 24.5131 |
| 554 | 20.2294 | | 554 | 24.5068 |
| 553 | 20.2257 | | 553 | 24.5228 |
| 552 | 20.2184 | | 552 | 24.5256 |
| 551 | 20.2131 | | 551 | 24.5403 |
| 550 | 20.2243 | | 550 | 24.5391 |
| 549 | 20.2372 | | 549 | 24.529 |
| 548 | 20.2569 | | 548 | 24.5373 |
| 547 | 20.2539 | | 547 | 24.5232 |
| 546 | 20.2515 | | 546 | 24.513 |
| 545 | 20.247 | | 545 | 24.5124 |
| 544 | 20.2386 | | 544 | 24.5075 |
| 543 | 20.253 | | 543 | 24.521 |
| 542 | 20.2539 | | 542 | 24.5296 |

FIG. 75

| Tape in black | | | Tape in white | |
|---|---|---|---|---|
| Wavelength (μm) | Light transmittance T (%) | | Wavelength (μm) | Light transmittance T (%) |
| 541 | 20.2593 | | 541 | 24.526 |
| 540 | 20.2634 | | 540 | 24.5242 |
| 539 | 20.2441 | | 539 | 24.5217 |
| 538 | 20.2413 | | 538 | 24.5108 |
| 537 | 20.2479 | | 537 | 24.5207 |
| 536 | 20.2415 | | 536 | 24.5317 |
| 535 | 20.2555 | | 535 | 24.5094 |
| 534 | 20.2679 | | 534 | 24.5083 |
| 533 | 20.2691 | | 533 | 24.5055 |
| 532 | 20.2725 | | 532 | 24.4893 |
| 531 | 20.276 | | 531 | 24.4886 |
| 530 | 20.2669 | | 530 | 24.4932 |
| 529 | 20.2592 | | 529 | 24.4959 |
| 528 | 20.2623 | | 528 | 24.4944 |
| 527 | 20.2488 | | 527 | 24.5004 |
| 526 | 20.2517 | | 526 | 24.4939 |
| 525 | 20.2495 | | 525 | 24.4807 |
| 524 | 20.252 | | 524 | 24.4883 |
| 523 | 20.2667 | | 523 | 24.4963 |
| 522 | 20.2737 | | 522 | 24.5038 |
| 521 | 20.2723 | | 521 | 24.4977 |
| 520 | 20.285 | | 520 | 24.5355 |
| 519 | 20.2935 | | 519 | 24.5278 |
| 518 | 20.2934 | | 518 | 24.5281 |
| 517 | 20.2879 | | 517 | 24.5196 |
| 516 | 20.2852 | | 516 | 24.5208 |
| 515 | 20.2749 | | 515 | 24.5132 |
| 514 | 20.266 | | 514 | 24.5149 |

FIG. 76

| Tape in black | | | Tape in white | |
|---|---|---|---|---|
| Wavelength (μm) | Light transmittance T (%) | | Wavelength (μm) | Light transmittance T (%) |
| 513 | 20.2734 | | 513 | 24.5115 |
| 512 | 20.2873 | | 512 | 24.5035 |
| 511 | 20.2863 | | 511 | 24.4997 |
| 510 | 20.2912 | | 510 | 24.4902 |
| 509 | 20.2869 | | 509 | 24.4864 |
| 508 | 20.2618 | | 508 | 24.4829 |
| 507 | 20.2571 | | 507 | 24.4649 |
| 506 | 20.2474 | | 506 | 24.4652 |
| 505 | 20.2454 | | 505 | 24.4714 |
| 504 | 20.2491 | | 504 | 24.4827 |
| 503 | 20.2592 | | 503 | 24.5087 |
| 502 | 20.2643 | | 502 | 24.5059 |
| 501 | 20.2703 | | 501 | 24.5262 |
| 500 | 20.2606 | | 500 | 24.5208 |
| 499 | 20.2538 | | 499 | 24.5275 |
| 498 | 20.2431 | | 498 | 24.5274 |
| 497 | 20.2408 | | 497 | 24.5016 |
| 496 | 20.2536 | | 496 | 24.4963 |
| 495 | 20.2588 | | 495 | 24.4814 |
| 494 | 20.27 | | 494 | 24.4812 |
| 493 | 20.2655 | | 493 | 24.4731 |
| 492 | 20.2701 | | 492 | 24.4789 |
| 491 | 20.2705 | | 491 | 24.4897 |
| 490 | 20.2674 | | 490 | 24.4902 |
| 489 | 20.2783 | | 489 | 24.5006 |
| 488 | 20.2706 | | 488 | 24.5023 |
| 487 | 20.266 | | 487 | 24.4879 |
| 486 | 20.2756 | | 486 | 24.4963 |

FIG. 77

| Tape in black | | | Tape in white | |
|---|---|---|---|---|
| Wavelength (μm) | Light transmittance T (%) | | Wavelength (μm) | Light transmittance T (%) |
| 485 | 20.2664 | | 485 | 24.5003 |
| 484 | 20.2624 | | 484 | 24.5048 |
| 483 | 20.2589 | | 483 | 24.5107 |
| 482 | 20.2467 | | 482 | 24.5108 |
| 481 | 20.2506 | | 481 | 24.4998 |
| 480 | 20.2457 | | 480 | 24.4864 |
| 479 | 20.2389 | | 479 | 24.4755 |
| 478 | 20.2341 | | 478 | 24.4569 |
| 477 | 20.233 | | 477 | 24.4777 |
| 476 | 20.2455 | | 476 | 24.4786 |
| 475 | 20.2711 | | 475 | 24.4886 |
| 474 | 20.2748 | | 474 | 24.4966 |
| 473 | 20.2699 | | 473 | 24.4904 |
| 472 | 20.2562 | | 472 | 24.4999 |
| 471 | 20.2455 | | 471 | 24.5052 |
| 470 | 20.2454 | | 470 | 24.5122 |
| 469 | 20.237 | | 469 | 24.5083 |
| 468 | 20.2555 | | 468 | 24.5078 |
| 467 | 20.2464 | | 467 | 24.4957 |
| 466 | 20.2485 | | 466 | 24.4988 |
| 465 | 20.2562 | | 465 | 24.4947 |
| 464 | 20.2589 | | 464 | 24.4802 |
| 463 | 20.2566 | | 463 | 24.4842 |
| 462 | 20.2385 | | 462 | 24.4546 |
| 461 | 20.2351 | | 461 | 24.4543 |
| 460 | 20.2227 | | 460 | 24.4401 |
| 459 | 20.224 | | 459 | 24.448 |
| 458 | 20.2359 | | 458 | 24.4615 |

FIG. 78

| Tape in black | | | Tape in white | |
|---|---|---|---|---|
| Wavelength (μm) | Light transmittance T (%) | | Wavelength (μm) | Light transmittance T (%) |
| 457 | 20.2255 | | 457 | 24.4513 |
| 456 | 20.2209 | | 456 | 24.4576 |
| 455 | 20.2292 | | 455 | 24.4581 |
| 454 | 20.2276 | | 454 | 24.4508 |
| 453 | 20.2392 | | 453 | 24.4583 |
| 452 | 20.2327 | | 452 | 24.4604 |
| 451 | 20.2357 | | 451 | 24.4427 |
| 450 | 20.2278 | | 450 | 24.442 |
| 449 | 20.246 | | 449 | 24.4422 |
| 448 | 20.2567 | | 448 | 24.4527 |
| 447 | 20.24 | | 447 | 24.4618 |
| 446 | 20.2605 | | 446 | 24.4706 |
| 445 | 20.2502 | | 445 | 24.4522 |
| 444 | 20.2491 | | 444 | 24.4544 |
| 443 | 20.2706 | | 443 | 24.462 |
| 442 | 20.2675 | | 442 | 24.4668 |
| 441 | 20.2662 | | 441 | 24.4815 |
| 440 | 20.2647 | | 440 | 24.4846 |
| 439 | 20.255 | | 439 | 24.4599 |
| 438 | 20.2474 | | 438 | 24.4477 |
| 437 | 20.2518 | | 437 | 24.4534 |
| 436 | 20.2708 | | 436 | 24.4532 |
| 435 | 20.2768 | | 435 | 24.4569 |
| 434 | 20.2944 | | 434 | 24.4747 |
| 433 | 20.3071 | | 433 | 24.4784 |
| 432 | 20.3026 | | 432 | 24.4818 |
| 431 | 20.3069 | | 431 | 24.5169 |
| 430 | 20.3146 | | 430 | 24.528 |

FIG. 79

| Tape in black | | | Tape in white | |
|---|---|---|---|---|
| Wavelength (μm) | Light transmittance T (%) | | Wavelength (μm) | Light transmittance T (%) |
| 429 | 20.3094 | | 429 | 24.5347 |
| 428 | 20.3135 | | 428 | 24.536 |
| 427 | 20.3431 | | 427 | 24.5587 |
| 426 | 20.3436 | | 426 | 24.5524 |
| 425 | 20.3452 | | 425 | 24.5336 |
| 424 | 20.3365 | | 424 | 24.5252 |
| 423 | 20.3023 | | 423 | 24.4771 |
| 422 | 20.2883 | | 422 | 24.4612 |
| 421 | 20.2542 | | 421 | 24.4479 |
| 420 | 20.3519 | | 420 | 24.5214 |
| 419 | 20.3317 | | 419 | 24.5087 |
| 418 | 20.3461 | | 418 | 24.4898 |
| 417 | 20.3088 | | 417 | 24.5051 |
| 416 | 20.3093 | | 416 | 24.4849 |
| 415 | 20.3189 | | 415 | 24.4649 |
| 414 | 20.2861 | | 414 | 24.418 |
| 413 | 20.3106 | | 413 | 24.4366 |
| 412 | 20.3504 | | 412 | 24.4542 |
| 411 | 20.3434 | | 411 | 24.4923 |
| 410 | 20.3624 | | 410 | 24.5297 |
| 409 | 20.3763 | | 409 | 24.5202 |
| 408 | 20.3645 | | 408 | 24.5415 |
| 407 | 20.4058 | | 407 | 24.5158 |
| 406 | 20.4277 | | 406 | 24.5275 |
| 405 | 20.4538 | | 405 | 24.5364 |
| 404 | 20.4669 | | 404 | 24.5238 |
| 403 | 20.4704 | | 403 | 24.5375 |
| 402 | 20.4856 | | 402 | 24.5262 |

FIG. 80

| Tape in black | | | Tape in white | |
|---|---|---|---|---|
| Wavelength (μm) | Light transmittance T (%) | | Wavelength (μm) | Light transmittance T (%) |
| 401 | 20.4931 | | 401 | 24.5059 |
| 400 | 20.4686 | | 400 | 24.5008 |
| 399 | 20.4815 | | 399 | 24.5177 |
| 398 | 20.4674 | | 398 | 24.5491 |
| 397 | 20.4531 | | 397 | 24.5543 |
| 396 | 20.4681 | | 396 | 24.5304 |
| 395 | 20.451 | | 395 | 24.4873 |
| 394 | 20.4502 | | 394 | 24.4508 |
| 393 | 20.457 | | 393 | 24.4543 |
| 392 | 20.4635 | | 392 | 24.4766 |
| 391 | 20.4562 | | 391 | 24.467 |
| 390 | 20.4748 | | 390 | 24.4731 |
| 389 | 20.4828 | | 389 | 24.4664 |
| 388 | 20.4921 | | 388 | 24.4512 |
| 387 | 20.5137 | | 387 | 24.485 |
| 386 | 20.5243 | | 386 | 24.4882 |
| 385 | 20.537 | | 385 | 24.4723 |
| 384 | 20.53 | | 384 | 24.4777 |
| 383 | 20.5091 | | 383 | 24.4205 |
| 382 | 20.4982 | | 382 | 24.4331 |
| 381 | 20.4867 | | 381 | 24.4308 |
| 380 | 20.4974 | | 380 | 24.4413 |
| 379 | 20.5128 | | 379 | 24.4548 |
| 378 | 20.5252 | | 378 | 24.4329 |
| 377 | 20.533 | | 377 | 24.4431 |
| 376 | 20.549 | | 376 | 24.4017 |
| 375 | 20.5672 | | 375 | 24.4495 |
| 374 | 20.5423 | | 374 | 24.4512 |

FIG. 81

| Tape in black | | | Tape in white | |
|---|---|---|---|---|
| Wavelength (μm) | Light transmittance T (%) | | Wavelength (μm) | Light transmittance T (%) |
| 373 | 20.5137 | | 373 | 24.4121 |
| 372 | 20.4948 | | 372 | 24.4155 |
| 371 | 20.4471 | | 371 | 24.3647 |
| 370 | 20.6176 | | 370 | 24.433 |
| 369 | 20.6285 | | 369 | 24.4398 |
| 368 | 20.63 | | 368 | 24.4208 |
| 367 | 20.6378 | | 367 | 24.4377 |
| 366 | 20.6263 | | 366 | 24.3924 |
| 365 | 20.6304 | | 365 | 24.3864 |
| 364 | 20.5925 | | 364 | 24.3719 |
| 363 | 20.5674 | | 363 | 24.3544 |
| 362 | 20.5724 | | 362 | 24.3364 |
| 361 | 20.5897 | | 361 | 24.325 |
| 360 | 20.5923 | | 360 | 24.3148 |
| 359 | 20.5976 | | 359 | 24.3192 |
| 358 | 20.5941 | | 358 | 24.3294 |
| 357 | 20.5357 | | 357 | 24.3049 |
| 356 | 20.5327 | | 356 | 24.3265 |
| 355 | 20.5756 | | 355 | 24.3461 |
| 354 | 20.5876 | | 354 | 24.3463 |
| 353 | 20.6694 | | 353 | 24.3066 |
| 352 | 20.6807 | | 352 | 24.259 |
| 351 | 20.6526 | | 351 | 24.1875 |
| 350 | 20.5758 | | 350 | 24.1681 |
| 349 | 20.5538 | | 349 | 24.2042 |
| 348 | 20.5614 | | 348 | 24.2366 |
| 347 | 20.5513 | | 347 | 24.2744 |
| 346 | 20.6026 | | 346 | 24.27 |

FIG. 82

| Tape in black | | | Tape in white | |
|---|---|---|---|---|
| Wavelength (μm) | Light transmittance T (%) | | Wavelength (μm) | Light transmittance T (%) |
| 345 | 20.5842 | | 345 | 24.2726 |
| 344 | 20.5875 | | 344 | 24.2595 |
| 343 | 20.5753 | | 343 | 24.2884 |
| 342 | 20.5627 | | 342 | 24.3097 |
| 341 | 20.5936 | | 341 | 24.2186 |
| 340 | 20.6817 | | 340 | 24.4226 |
| 339 | 20.6141 | | 339 | 24.3418 |
| 338 | 20.6054 | | 338 | 24.2955 |
| 337 | 20.6289 | | 337 | 24.3183 |
| 336 | 20.6219 | | 336 | 24.2753 |
| 335 | 20.6507 | | 335 | 24.2949 |
| 334 | 20.6177 | | 334 | 24.2512 |
| 333 | 20.5812 | | 333 | 24.2405 |
| 332 | 20.5679 | | 332 | 24.2144 |
| 331 | 20.5333 | | 331 | 24.204 |
| 330 | 20.547 | | 330 | 24.1824 |
| 329 | 20.555 | | 329 | 24.137 |
| 328 | 20.5357 | | 328 | 24.1176 |
| 327 | 20.5497 | | 327 | 24.1288 |
| 326 | 20.5702 | | 326 | 24.1553 |
| 325 | 20.5403 | | 325 | 24.1866 |
| 324 | 20.5184 | | 324 | 24.1403 |
| 323 | 20.541 | | 323 | 24.1148 |
| 322 | 20.5017 | | 322 | 24.0971 |
| 321 | 20.5689 | | 321 | 24.0591 |
| 320 | 20.5425 | | 320 | 24.0259 |
| 319 | 20.5033 | | 319 | 24.0071 |
| 318 | 20.4925 | | 318 | 23.9693 |

FIG. 83

| Tape in black | | | Tape in white | |
|---|---|---|---|---|
| Wavelength (μm) | Light transmittance T (%) | | Wavelength (μm) | Light transmittance T (%) |
| 317 | 20.3814 | | 317 | 23.9191 |
| 316 | 20.3944 | | 316 | 23.9077 |
| 315 | 20.3611 | | 315 | 23.8309 |
| 314 | 20.3148 | | 314 | 23.7724 |
| 313 | 20.3263 | | 313 | 23.7474 |
| 312 | 20.3185 | | 312 | 23.7024 |
| 311 | 20.268 | | 311 | 23.6667 |
| 310 | 20.2401 | | 310 | 23.6223 |
| 309 | 20.2116 | | 309 | 23.5775 |
| 308 | 20.1932 | | 308 | 23.5861 |
| 307 | 20.2089 | | 307 | 23.571 |
| 306 | 20.2418 | | 306 | 23.5969 |
| 305 | 20.2418 | | 305 | 23.5923 |
| 304 | 20.2126 | | 304 | 23.5743 |
| 303 | 20.2326 | | 303 | 23.5207 |
| 302 | 20.1922 | | 302 | 23.4827 |
| 301 | 20.2358 | | 301 | 23.4931 |
| 300 | 20.2827 | | 300 | 23.4682 |

TAPE FOR SLIDE FASTENER

CROSS REFERENCE TO RELATED APPLICATIONS

This application is based on Chinese Patent Application (No. 201711249063.0) filed on Dec. 1, 2017 and Chinese Utility Model Application (No. 201721651179.2) filed on Dec. 1, 2017, the contents of which are incorporated herein by way of reference.

BACKGROUND

The present invention relates to a tape for a slide fastener.

The present invention also relates to a slide fastener comprising the above-mentioned tape for a slide fastener.

As a daily necessity, slide fasteners are widely used in various fields, especially in a large number of articles such as clothing, bags, etc. At present, there are mainly three kinds: nylon slide fasteners, resin slide fasteners and metal slide fasteners, and each has a tape, slide-fastener elements, a slider and other main components, regardless of the kind of the slide fasteners. In terms of functions, slide fasteners are mainly used to achieve opening and closing of items; however, in some industries, especially the clothing industry, slide fasteners are sometimes required to have other functions, such as light weight. In Chinese invention patent application No. 201080069345.2, the description discloses a woven tape (i.e., a tape) for a slide fastener, which, by setting yarn count of warps of the yarns forming the woven tape, weave density of the warps (i.e., yarn count density of the warps), yarn count of wefts, and weave density of the wefts (i.e., yarn count density of the wefts), provides a woven tape having both light weight and strength for a slide fastener. However, with technology development, there is a demand for lighter weight of tapes, and obviously, a tape in the prior art cannot meet the demand for lighter weight. In addition, since the length of the tape is much larger than the width thereof, when a slide fastener having the above tape is attached to an article, the tape is subjected to a large force in the width direction thereof, and due to the lightweight design of the tape, the side tensile strength is very weak, which in turn causes the tape to be extremely undurable.

SUMMARY

In view of the aforementioned shortcomings of the prior art, an object of the present invention is to provide a tape for a slide fastener and a slider fastener, which can achieve lighter weight and effectively improve the side tensile strength of the tape simultaneously.

To achieve the above object, the present invention provides a tape for a slide fastener, wherein, for warps among yarns forming the tape, yarn count is set to 22-28 dTex and weave density is set to 205-231 yarns/inch, and for wefts among yarns forming the tape, yarn count is set to 81-87 dTex and weave density is set to 42-48 yarns/inch, and the weft is a multifilament formed by bundling 33-39 monofilaments. By setting the warp count, the weave density, the weft count and the weave density for the yarns forming the tape for a slide fastener, as well as setting the multifilament structure of the wefts, a tape with lighter weight is obtained, and the strength of the tape itself and especially the side tensile strength of the tape along the width direction thereof is effectively improved simultaneously, thereby greatly improving durability of the tape, making the tape thin, lightweight and strong, and thus making the tape meet requirements of various aspects.

In a preferred embodiment of the above tape for a slide fastener, the yarn count of the warps is set to 25 dTex, the weave density of the warps is set to 210-226 yarns/inch, the yarn count of the wefts is set to 84 dTex, the weave density of the wefts is set to 43-46 yarns/inch, and the weft is multifilament formed by bundling 36 monofilaments.

After the tape is woven by using the features set as above, the tape has a thickness of 0.1-0.2 mm, which is lighter and thinner than a tape in the prior art, thereby achieving lighter weight of the tape.

Further, when using the yarns to weave the tape, the warps and the wefts are interwoven one by one, and the thus-woven tape is a plain woven construction, which ensures strength and durability of the tape; moreover, as the warp and the weft are both very fine, the tape with a plain weave still has good flexibility, thereby ensuring the texture of the tape.

The tape woven by using the features set as above is very thin and light, and can have transparency even without using transparent yarns. In the embodiment, the light transmittance of the tape is 15%-30%.

Preferably, in order to further increase the light transmittance of the tape, the tape is made from one of polyethylene terephthalate, polypropylene, and polyamide.

In a preferred embodiment of the above tape for a slide fastener, an outer periphery of the tape has a tape edge portion. The tape edge portion is obtained by ultrasonic-wave cutting, which, under the premise of no need to provide a selvedge thread, can effectively prevent looseness of the yarns at the tape edge portion of the tape, and also ensures that the thickness of the tape edge portion is very approximate to the thickness of the rest part of the tape.

The present invention also provides a slide fastener comprising two rows of fastener stringers, a slider, and a pair of tapes as described above, wherein the inner-side edges of the pair of tapes is each provided with one row of the fastener stringer, and the slider is clamped on the two rows of fastener stringers to achieve engagement or disengagement of the two rows of fastener stringers.

In a preferred embodiment of the above slide fastener, the slide fastener is a nylon slide fastener, and the fastener stringer is in a spiral-coil shape and is sewn and fixed to the tape by an element sewing thread.

In a preferred embodiment of the above nylon slide fastener, there is a folded portion formed by folding the tape along the width direction thereof at the inner-side edge of the tape. The folded portion and a portion of the tape that overlaps with the folded portion form an element attaching portion of the tape. The fastener stringer is sewn and fixed to the element attaching portion by the element sewing thread. Along the width direction of the tape, the element sewing thread sewn on the element attaching portion is located between both ends of the element attaching portion, to facilitate the sewing of the fastener stringers.

As described above, the tape for a slide fastener and the slide fastener according to the present invention, have the following advantages.

In the above-described tape for a slide fastener and the above-described slide fastener, by setting the warp count, the weave density, the weft count and the weave density for the yarns forming the tape, as well as setting the multifilament structure of the wefts, the tape with lighter weight is obtained, and the strength of the tape itself and especially the side tensile strength of the tape along the width direction thereof is effectively improved simultaneously, thereby greatly improving durability of the tape, making the tape thin, lightweight and strong, and thus making the tape meet requirements of various aspects.

BRIEF DESCRIPTION OF DRAWINGS

FIGS. 5 to 83 are tables showing a light transmittance of tape in black and tape in white in correspondence with irradiation of different wavelengths of light.

DETAILED DESCRIPTION OF EXEMPLIFIED EMBODIMENTS

Specific embodiments are provided to describe implementation of the present invention, and other advantages and functions of the present invention can be easily understood by a person skilled in the art from the disclosure in the following description.

It should be noted that, the structures, scales, sizes and the like shown in all the drawings, are only used to match the content disclosed in the specification, for being read and understood by a person skilled in the art, instead of limiting restricted implementation conditions of the present disclosure, and thus do not have any essential technical meaning. Any modification in structure, change in scale, or adjustment in size should fall within the scope of the technical content disclosed by the present disclosure without influencing the generated efficacy and achieved objective of the present disclosure. Meanwhile, some words such as "upper", "lower", "left", "right", "middle", and "a" quoted in the specification are only used for clarifying the illustration, instead of limiting the implementation scope of the present disclosure, and any change or adjustment of relative relationships thereof without essentially changing the technical content should be considered as falling within the scope of implementation of the present disclosure.

Figure 3:
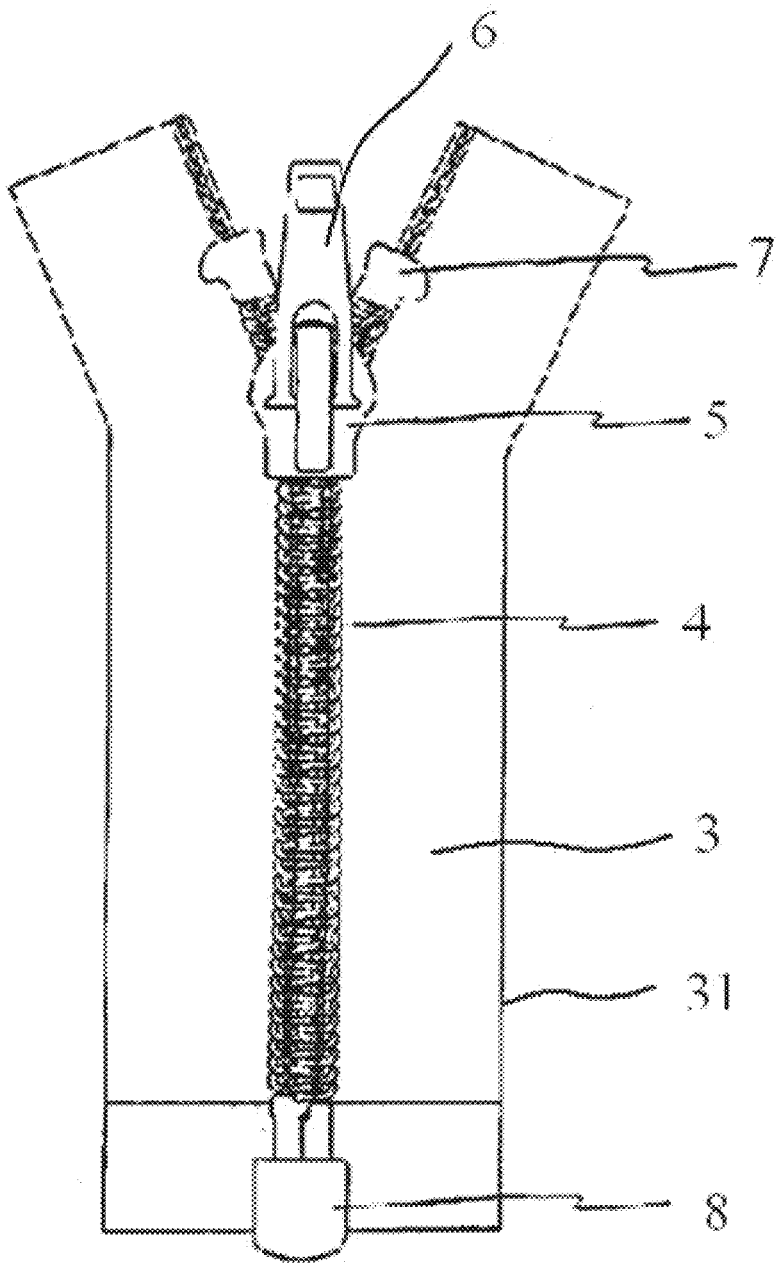
FIG. 3 is a schematic structural view of a nylon slide fastener in the present application.

In the following embodiments, directions are defined as follows: a longitudinal direction of a slide fastener is defined as a front-rear direction; a width direction of the slide fastener is defined as a left-right direction; a direction orthogonal to both the front-rear direction and the left-right direction is defined as an up-down direction; further, a direction in which the slider 5 moves toward a top stop 7 of the slide fastener is the front direction, and a direction in which a slider 5 moves toward a bottom stop 8 of the slide fastener is a rear direction. Thus, the front-rear direction coincides with the moving direction of the slider 5 in the slide fastener, and the up-down direction coincides with the thickness direction of a tape 3 in the slide fastener. Alternatively, as shown in FIG. 3, an upper side of the paper surface is a front direction, a lower side of the paper surface is a rear direction, a left side of the paper surface is a left direction, a right side of the paper surface is a right direction, a front side of the paper surface is an up direction, and a back side of the paper surface is a down direction.

Figure 1:
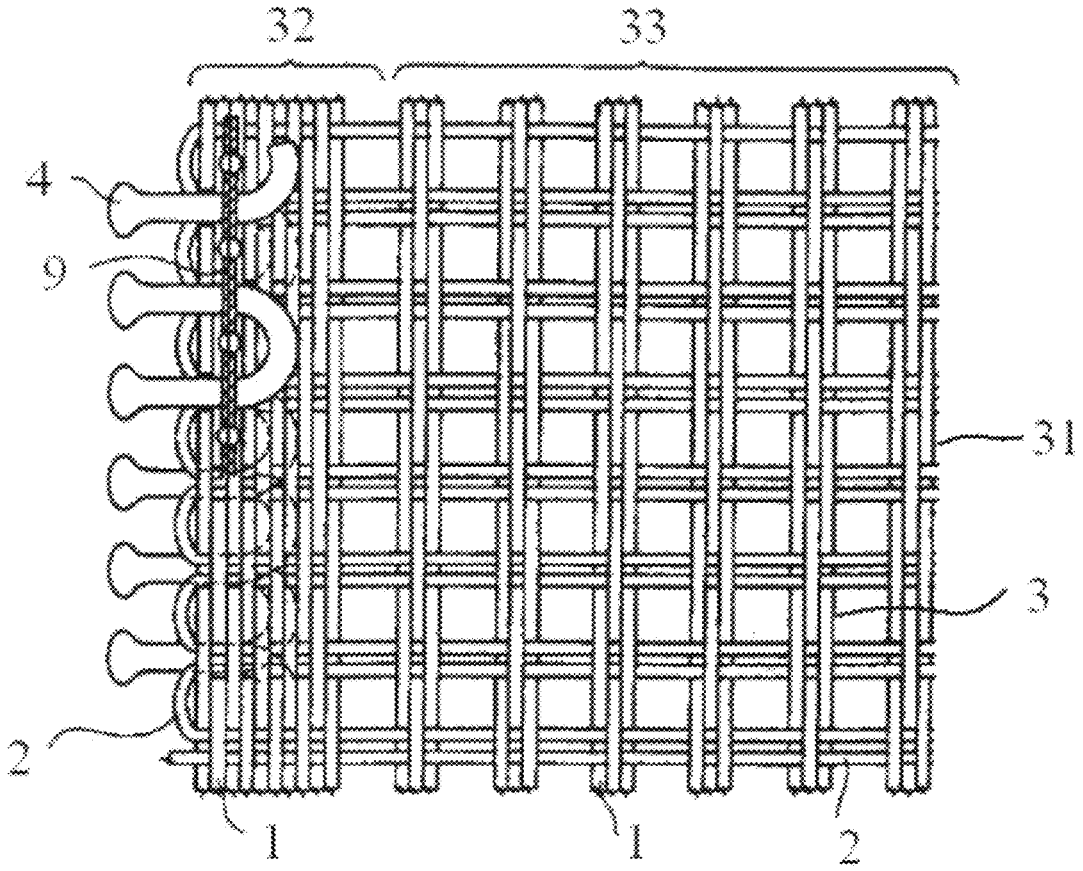
FIG. 1 is a schematic structural view of a tape in the present application.

The present invention provides the tape 3 for a slide fastener, which achieves the lighter weight and thinness of the tape 3, and can ensure the strength of the tape 3, especially the side tensile strength of the tape 3 along the width direction thereof. The tape 3 for a slide fastener adopts the following configuration: as shown in FIG. 1, for warps 1 (i.e., the vertical yarns extending front-to-rear) among the yarns forming the tape 3, the yarn count is set to 22-28 dTex and the weave density is set to 205-231 yarns/inch (i.e., 80-91 yarns/cm); for wefts 2 (i.e., the transverse yarns extending left-to-right) among the yarns forming the tape 3, the yarn count is set to 81-87 dTex and the weave density is set to 42-48 yarns/inch (i.e., 16-19 yarns/cm), and the weft 2 is a multifilament formed by bundling 33-39 monofilaments. In the tape 3 for a slide fastener, by setting the warp count, the weave density of the warp, the weft count and the weave density of the weft for the yarns forming the tape 3, as well as setting the multifilament structure of the wefts, the tape 3 is made thinner and more lightweight. In particular, because the tape 3 has a relatively long length in the front-rear direction and a relatively short width in the left-right direction, so, after the slide fastener is attached to an article such as clothes, forces applied to the slide fastener mainly come from the width direction of the slide fastener. In other words, the tape 3 mainly bears side tensile forces in the width direction thereof. In the present application, among the yarns forming the tape 3, the weft 2 is always thicker than the warp 1, and each of the wefts 2 is set to be a multifilament formed by bundling 33-39 monofilaments, which can increase the side tensile strength of the tape 3 in the width direction thereof to a large extent, making the extremely lightweight and thin tape 3 durable. Therefore, the tape 3 for a slide fastener according to the present application is thin, lightweight and strong, and thus can meet requirements of various aspects.

In a preferred embodiment of the above tape for a slide fastener, the yarn count of the warps 1 is set to 25 dTex (i.e., 22.5 D), the weave density of the warps 1 is set to 210-226 yarns/inch (i.e., 83-89 yarns/cm), the yarn count of the wefts 2 is set to 84 dTex, the weave density of the wefts 2 is set to 43-46 yarns/inch (i.e., 17-18 yarns/cm), the warp 1 is a monofilament, and the weft 2 is a multifilament formed by bundling 36 monofilaments. In this way, under the premise of ensuring the strength of the tape 3, the lightness and thinness of the tape 3 can be maximized.

Further, when using the yarns to weave the tape 3, the warps 1 and the wefts 2 are interwoven one by one, and the thus-woven tape 3 is entirely a plain woven construction, which ensures strength and durability of the tape 3 and makes the appearance of the tape 3 uniform. Moreover, as the warp 1 and the weft 2 are both very fine, even though the tape 3 is entirely a plain woven construction, the tape 3 still has good flexibility, thereby ensuring the texture of the tape 3. In production of the tape 3, firstly, a tape blank woven from the warps 1 and the wefts 2 is obtained, then the tape blank is subjected to ultrasonic-wave cutting according to a required size of the tape 3, thereby obtaining the tape 3. The front edge, the rear edge, the left edge and the right edge of the tape 3 are all tape edge portions 31 obtained by ultrasonic-wave cutting of the tape blank. Thus, the tape edge portions 31 are very smooth, and no fluffing, snagging, deformation, and the like phenomenon occurs at the tape edge portions 31, so that, under the premise of no need to provide a selvedge thread, the tape 3 can effectively prevent looseness of the yarns at the tape edge portions 31. In addition, as the tape 3 is very lightweight and thin, the thickness of the tape 3 at the tape edge portions 31 is very approximate to the thickness of the rest part of the tape 3 after the ultrasonic-wave cutting, and it is visually impossible to recognize the difference between the thickness of the tape edge portions 31 and the thickness of the rest part of the tape 3, which greatly improves the uniformity and aesthetics of the appearance of the tape 3.

Figure 2:
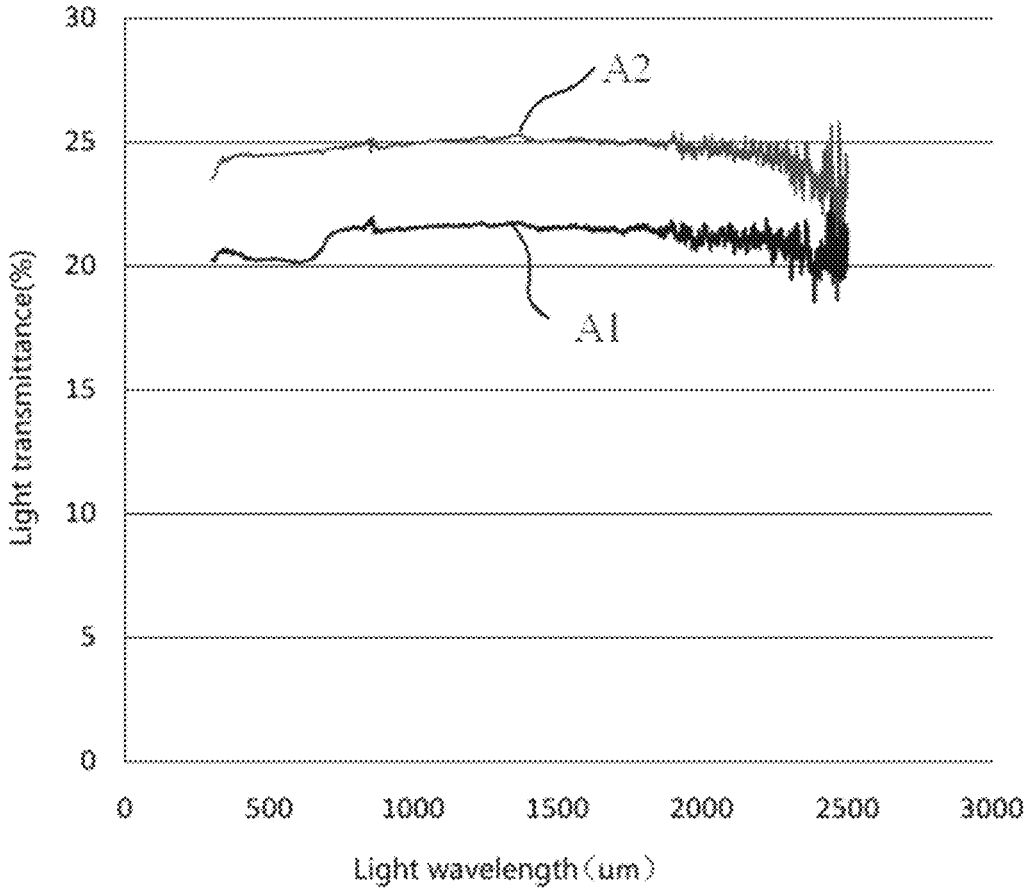
FIG. 2 is a diagram showing a corresponding relationship between light transmittance and light wavelength, when the tape in the present application is in two colors, i.e., in black and in white.

The tape 3 woven by using the features set as above has a thickness of 0.1-0.2 mm which is lighter and thinner than a tape in the prior art, thereby achieving lighter weight of the tape 3. In addition, as the tape 3 is very thin and lightweight, the tape 3 can have transparency even without using transparent yarns. A light transmittance experiment was carried out respectively on the tape 3 in black and the tape 3 in white by using a spectrophotometer, and the experimental results are shown in FIGS. 5 to 83 and FIG. 2. In FIG. 2, curve A1 is an experimental result curve for the tape 3 in black, and curve A2 is an experimental result curve for the tape 3 in white, and it can be seen that the light transmittance of the tape 3 is 15%-30%, the light transmittance of the tape 3 in black is about 20.22%, and the light transmittance of the tape 3 in white is about 24.53%.

FIGS. 5 to 83 show a light transmittance of tape in black and tape in white in correspondence with irradiation of different wavelengths of light.

To further increase the light transmittance of the tape 3, the tape 3 is made from one of polyethylene terephthalate (PET), polypropylene (PP), and polyamide (PA).

The present invention also provides a slide fastener, as shown in FIG. 3, the slide fastener mainly comprises a pair of tapes 3 as described above, two rows of fastener stringers 4, a slider 5, a pull tab 6, a top stop 7 and a bottom stop 8.

The two tapes 3 in the pair of tapes 3 extend front-to-rear and are arranged side by side; the two rows of fastener stringers 4 are respectively disposed on the inner-side edges of the respective tapes 3, and each row of fastener stringer 4 is composed of a plurality of fastener elements arranged one behind the other.

The slider 5 is clamped on the two rows of fastener stringers 4 and moves back and forth along the extending direction of the fastener stringers 4, for achieving engagement or disengagement of the two rows of fastener stringers 4.

The pull tab 6 is mounted on the slider 5, so that a user can hold the pull tab 6 with a hand to bring the slider 5 to move back and forth; the top stop 7 is disposed at the front end of the fastener stringers 4, and is used for restricting the slider 5 from being detached from the fastener stringers 4 forwardly from the front end of the fastener stringers 4 when the slide fastener is pulled to close.

The bottom stop 8 is disposed at the rear end of the fastener stringers 4, and is used for restricting the slider 5 from being detached from the fastener stringers 4 backwardly from the rear end of the fastener stringers 4 when the slide fastener is pulled to open, and the bottom stop 8 also prevents the rear ends of the two rows of fastener stringers 4 from being separated from each other when the two rows of fastener stringers 4 are engaged.

Figure 4:
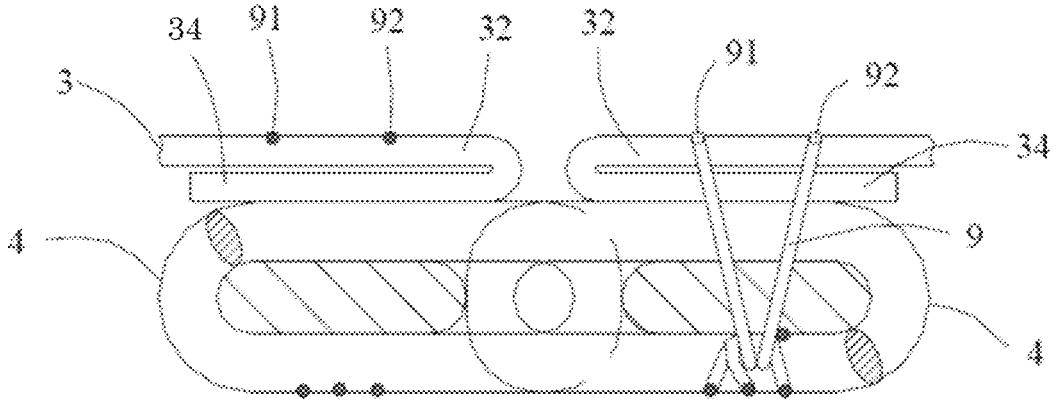
FIG. 4 is a cross-sectional view of FIG. 3.

Preferably, the slide fastener is a nylon slide fastener, in other words, a coil-type slide fastener; in the nylon slide fastener, as shown in FIG. 3 and FIG. 4, the fastener stringer 4 is in a spiral-coil shape, and is sewn and fixed to the tape 3 by an element sewing thread 9.

Further, each of the tapes 3 has an element attaching portion 32 and a tape body portion 33; the element attaching portion 32 is located on the inner side of the tape 3 and extends front-to-rear and is used for attaching of the fastener stringer 4; except the element attaching portion 32, the rest part of the tape 3 forms the tape body portion 33; in the nylon slide fastener, the fastener stringer 4 is sewn and fixed to the element attaching portion 32 by the element sewing thread 9.

As the tape 3 is very lightweight and thin, in order to facilitate sewing of the fastener stringers 4, the element attaching portion 32 has a two-layer (i.e., upper-and-lower-layer) structure; specifically, as shown in FIG. 4, the inner-side edge of the tape 3 is formed with a folded portion 34 by folding along the width direction of the tape 3, and the folded portion 34 is located on the lower side; the folded portion 34 and a portion of the tape 3 that overlaps with the folded portion 34 together form the element attaching portion 32 of the tape 3; thus, the portion of the tape 3 that is located above the folded portion 34 and overlaps with the folded portion 34 forms the upper-layer structure of the element attaching portion 32, while the folded portion 34 forms the lower-layer structure of the element attaching portion 32; hence, the thickness and hardness of the element attaching portion 32 with the two-layer (i.e., the upper-and-lower-layer) structure are remarkably improved, thus facilitating sewing of the fastener stringers 4.

Moreover, as shown in FIG. 4, along the width direction of the tape 3, the element sewing thread 9 sewn on the element attaching portion 32 is located between both ends of the element attaching portion 32, which means that, the width of the element attaching portion 32 is larger than the distance between the two segments (i.e., left-and-right segments) of the element sewing thread 9 sewn on the element attaching portion 32, that is, the left end of the element attaching portion 32 goes leftward beyond a left segment 91 of the element sewing thread on the element attaching portion 32, and the right end of the element attaching portion 32 goes rightward beyond a right segment 92 of the element sewing thread on the element attaching portion 32.

In summary, the present invention effectively overcomes various shortcomings in the prior art, and has a high utilization value in industry.

The above-described embodiments are merely for illustration of the principle and efficacy of the present invention by way of examples, and are not intended to limit the present invention. Modifications or changes can be made to the above-described embodiments by a person skilled in the art, without departing from the spirit and scope of the present invention. Thus, all equivalent modifications or changes made by a person having common knowledge in the art, without departing from the spirit and technical ideas disclosed by the present invention, shall still be encompassed by the claims of the present invention.

What is claimed is:

1. A fastener tape for a slide fastener, wherein a yarn count of warps among yarns forming the fastener tape is set to 22-28 dTex, a weave density of the warps is set to 205-231 yarn/inch, a yarn count of wefts among the yarns forming the fastener tape is set to 81-87 dTex, a weave density of the wefts is set to 42-48 yarns/inch, the wefts are multifilaments formed by bundling 33-39 monofilaments, and a light transmittance of the fastener tape is 15%-30%.

* * * * *